US007731636B2

(12) United States Patent
Lull et al.

(10) Patent No.: US 7,731,636 B2
(45) Date of Patent: Jun. 8, 2010

(54) RESISTANCE SYSTEM FOR AN EXERCISE DEVICE

(75) Inventors: Andrew P. Lull, Boulder, CO (US); Timothy Tetreault, Boulder, CO (US); Keith M. Weier, Poway, CA (US); Callan Paul McMahon, Cincinnati, OH (US); Timothy Todd Skarzynski, Niwot, CO (US); Zachary David Tyler, Lafayette, CO (US); Christopher Williams, Pleasanton, CA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 11/744,582

(22) Filed: May 4, 2007

(65) Prior Publication Data

US 2008/0070758 A1 Mar. 20, 2008

Related U.S. Application Data

(60) Provisional application No. 60/746,505, filed on May 5, 2006.

(51) Int. Cl.
*A63B 22/02* (2006.01)
*A63B 22/04* (2006.01)

(52) U.S. Cl. ..... 482/52; 482/54

(58) Field of Classification Search ..... 482/51–54, 482/57, 70, 71; *A63B 22/02, 22/04*
See application file for complete search history.

(56) References Cited

U.S. PATENT DOCUMENTS 580,420 A 4/1897 Nickerson
782,010 A 2/1905 Dodge
783,769 A 2/1905 Wright
964,898 A 7/1910 Budingen
1,850,530 A 3/1932 Brown (Continued)

FOREIGN PATENT DOCUMENTS

CN 2510102 Y 9/2002

(Continued)

OTHER PUBLICATIONS www.dictionary.com, definition of "translate", Dec. 2, 2009, p. 1 of 1.*

(Continued)

*Primary Examiner*—Loan H Thanh
*Assistant Examiner*—Oren Ginsberg
(74) *Attorney, Agent, or Firm*—Dorsey & Whitney LLP

(57) ABSTRACT

A resistance system for an exercise device may include: a drive shaft configured to be operably connected to a movable part of an exercise device such that movement of the movable part causes the drive shaft to rotate; and a resistance source operably connected with the drive shaft and configured to resist rotation of the drive shaft. An exercise device may include: a drive shaft rotatably supported by a frame; a resistance source operably connected with the drive shaft and configured to resist rotation of the drive shaft; and first and second treadle assemblies pivotally connected with the frame and including respective moving surfaces. In such an exercise device, the first treadle assembly and the second treadle assembly may be operably connected with the drive shaft such that pivotal movement of the first treadle assembly and pivotal movement of the second treadle assembly cause the drive shaft to rotate.

28 Claims, 22 Drawing Sheets

U.S. PATENT DOCUMENTS

| | | | | |
|---|---|---|---|---|
| 1,899,255 | A | 2/1933 | Bell | |
| 2,603,486 | A | 7/1952 | Hughes | |
| 2,969,060 | A | 1/1961 | Swanda et al. | |
| 3,316,898 | A | 5/1967 | Brown | |
| 3,408,067 | A | 10/1968 | Armstrong | |
| 3,511,500 | A | 5/1970 | Dunn | |
| 3,578,800 | A | 5/1971 | DiNepi | |
| 3,704,886 | A | 12/1972 | Kay et al. | |
| 3,792,860 | A | 2/1974 | Selnes | |
| 3,814,420 | A | 6/1974 | Encke | |
| 3,824,994 | A | 7/1974 | Soderberg, Sr. | |
| 4,082,267 | A | 4/1978 | Flavell | |
| 4,185,622 | A | 1/1980 | Swenson | |
| 4,204,673 | A | 5/1980 | Speer, Sr. | |
| 4,708,338 | A | 11/1987 | Potts | |
| 4,927,136 | A | 5/1990 | Leask | |
| 4,949,993 | A * | 8/1990 | Stark et al. | 482/52 |
| 4,989,857 | A | 2/1991 | Kuo | |
| 5,013,031 | A | 5/1991 | Bull | |
| 5,039,087 | A | 8/1991 | Kuo | |
| 5,054,770 | A | 10/1991 | Bull | |
| 5,135,447 | A | 8/1992 | Robards, Jr. et al. | |
| 5,199,934 | A | 4/1993 | Lin | |
| 5,238,462 | A | 8/1993 | Cinke et al. | |
| 5,308,300 | A * | 5/1994 | Chino et al. | 482/52 |
| 5,336,146 | A | 8/1994 | Piaget et al. | |
| 5,374,227 | A | 12/1994 | Webb | |
| 5,431,612 | A | 7/1995 | Holden | |
| 5,626,539 | A | 5/1997 | Piaget et al. | |
| 5,669,856 | A | 9/1997 | Liu | |
| 5,749,807 | A | 5/1998 | Webb | |
| 5,947,872 | A | 9/1999 | Ryan et al. | |
| 6,461,279 | B1 | 10/2002 | Kuo | |
| 6,626,802 | B1 * | 9/2003 | Rodgers, Jr. | 482/51 |
| 6,811,517 | B1 | 11/2004 | Eschenbach | |
| 6,811,519 | B2 | 11/2004 | Kuo | |
| 6,923,745 | B2 | 8/2005 | Stearns | |
| 7,097,593 | B2 | 8/2006 | Chang | |
| 7,306,546 | B2 | 12/2007 | Lo | |
| 2001/0016542 | A1 | 8/2001 | Yoshimura | |
| 2004/0162193 | A1 * | 8/2004 | Gray et al. | 482/70 |
| 2004/0192514 | A1 | 9/2004 | Piaget et al. | |
| 2004/0214693 | A1 | 10/2004 | Piaget et al. | |
| 2005/0209059 | A1 | 9/2005 | Crawford et al. | |
| 2005/0209060 | A1 | 9/2005 | Lull | |
| 2005/0209061 | A1 | 9/2005 | Crawford et al. | |
| 2005/0233864 | A1 | 10/2005 | Smith et al. | |
| 2005/0245359 | A1 * | 11/2005 | Lo | 482/54 |
| 2006/0223680 | A1 | 10/2006 | Chang | |

FOREIGN PATENT DOCUMENTS

| | | | |
|---|---|---|---|
| CN | 2675190 | Y | 2/2005 |
| GB | 2 241 176 | A | 8/1991 |
| TW | 547102 | Y | 8/2003 |
| TW | M249682 | | 11/2004 |
| WO | WO 95/16502 | A1 | 6/1995 |

OTHER PUBLICATIONS

"Nautilus Home Health & Fitness Catalog", Nautilus, Inc., pp. 1-56 (2004).

* cited by examiner

RESISTANCE SYSTEM FOR AN EXERCISE DEVICE

CROSS-REFERENCE TO RELATED APPLICATIONS

This present application is a nonprovisional application claiming priority to copending provisional application 60/746,505 titled "Resistance System For a Dual Deck Treadmill Device," filed May 5, 2006, which is hereby incorporated by reference herein.

The present application incorporates by reference in its entirety, as if fully described herein, the subject matter disclosed in the following U.S. applications and patents: U.S. Provisional Patent Application No. 60/548,265 titled "Exercise Device with Treadles" filed on Feb. 26, 2004; U.S. Provisional Patent Application No. 60/548,787 titled "Hydraulic Resistance, Arm Exercise, and Non-Motorized Dual Deck Treadmills" filed on Feb. 26, 2004; U.S. Provisional Patent Application No. 60/548,786 titled "Control System and Method for an Exercise Apparatus" filed on Feb. 26, 2004; U.S. patent application Ser. No. 10/789,182 titled "Dual Deck Exercise Device" filed on Feb. 26, 2004; U.S. patent application Ser. No. 10/789,294 titled "Exercise Device with Treadles" filed on Feb. 26, 2004; U.S. patent application Ser. No. 10/789,579 titled "System and Method for Controlling an Exercise Apparatus" filed on Feb. 26, 2004; U.S. Provisional Patent Application No. 60/451,104 titled "Exercise Device with Treadles" filed on Feb. 28, 2003; U.S. Provisional Patent Application No. 60/450,789 titled "Dual Deck Exercise Device" filed on Feb. 28, 2003; U.S. Provisional Patent Application No. 60/450,890 titled "System and Method for Controlling an Exercise Apparatus" filed on Feb. 28, 2003; U.S. Provisional Patent Application No. 60/548,811 titled "Dual Treadmill Exercise Device having a Single Rear Roller" filed on Feb. 26, 2004; U.S. Design Pat. Application No. 29/176,966 titled "Exercise Device with Treadles" filed on Feb. 28, 2003, now U.S. Pat. No. D534,973; U.S. patent application Ser. No. 11/065,891 titled "Exercise Device with Treadles" filed on Feb. 25, 2005; U.S. patent application Ser. No. 11/067,538 entitled "Control System and Method for an Exercise Apparatus" filed on Feb. 25, 2005; U.S. patent application Ser. No. 11/065,770 entitled "Dual Treadmill Exercise Device Having a Single Rear Roller" and filed on Feb. 25, 2005; U.S. patent application Ser. No. 11/065,746 entitled "Upper Body Exercise and Flywheel Enhanced Dual Deck Treadmills" and filed on Feb. 25, 2005; U.S. patent application Ser. No. 10/637,628 entitled "Combination of Treadmill and Stair Climbing Machine" file on Aug. 11, 2003, now U.S. Pat. No. 7,097,593; U.S. patent application No. 29/201,898 entitled "Exercise Device with Treadles" filed on Mar. 22, 2004, now U.S. Pat. No. D527,060; U.S. Pat. No. 5,626,539 entitled "Treadmill Apparatus with Dual Spring-Loaded Treadles" filed on Jan. 19, 1996; U.S. Pat. No. 6,461,279 entitled "Treadmill Having Dual Treads for Stepping Exercises" filed on Jul. 25, 2001; and U.S. Pat. No. RE34,959 entitled "Stair-Climbing Exercise Apparatus", which is a reissue of U.S. Pat. No. 4,708,338 filed on Aug. 4, 1986.

INTRODUCTION

The present invention generally involves the field of exercise devices and, more particularly involves resistance systems for exercise devices. More particularly, the present invention relates to resistance systems for exercise devices including treadles with moving surfaces provided thereon.

BACKGROUND

The health benefits of regular exercise are well known. Many different types of exercise equipment have been developed over time with success, to facilitate exercise. Examples of successful classes of exercise equipment include the treadmill and stair climbing machine. A conventional treadmill typically includes a continuous belt providing a moving surface that a user may walk, jog, or run on. A conventional stair climbing machine typically includes a pair of links adapted to pivot up and down providing a pair of surfaces or pedals that user may stand on and press up and down to simulate walking up a flight of stairs.

DETAILED DESCRIPTION

Figure 1:
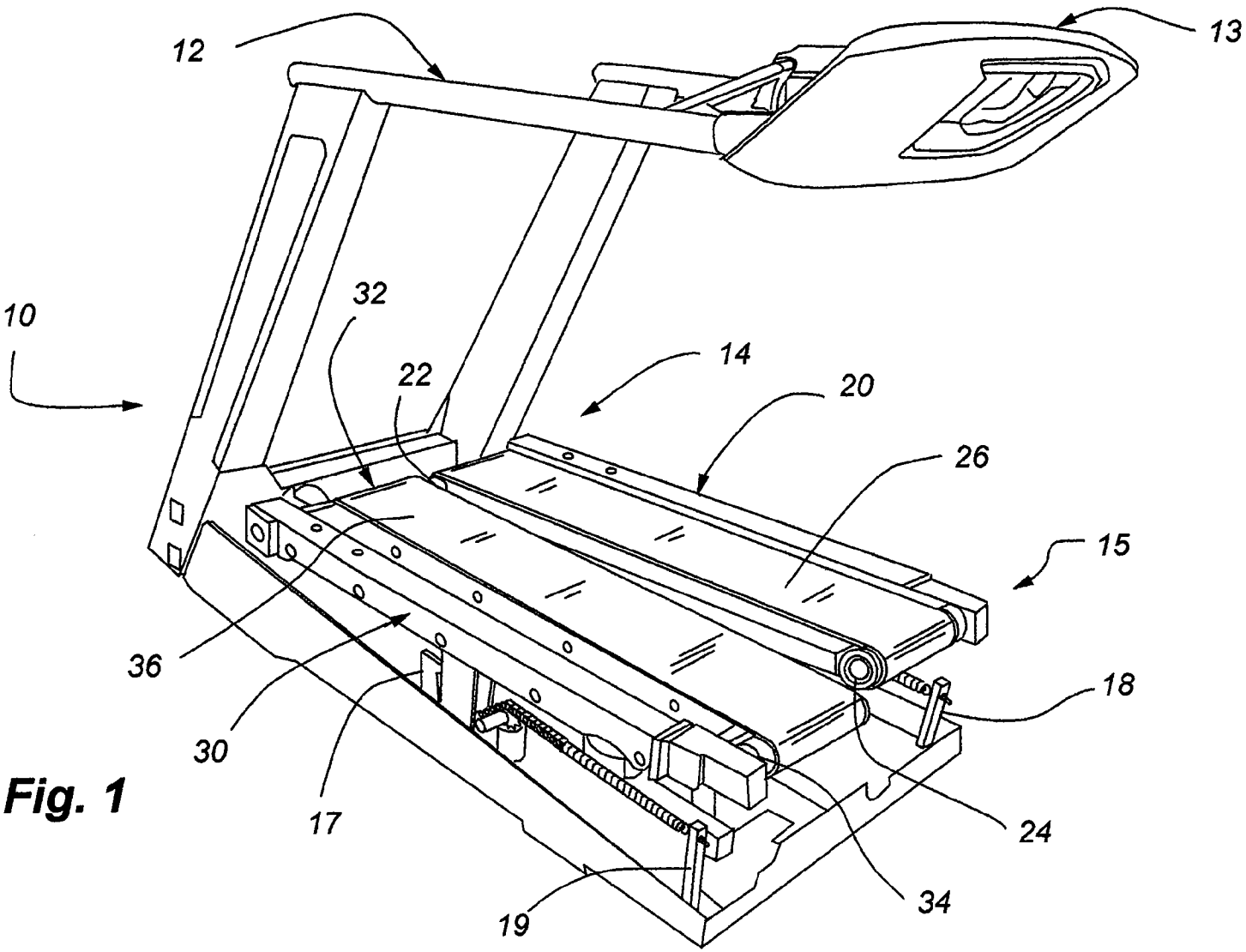
FIG. 1 is a diagrammatic view of a dual deck treadmill exercise device of the present invention.

Various embodiments and aspects of the present invention involve an exercise machine that provides side-by-side moving surfaces that are providing support at one end and adapted to pivot up and down at the opposite end. With a device conforming to the present invention, two pivotal moving surfaces are provided in a manner that provides some or all of the exercise benefits of using a treadmill with some or all of the exercise benefits of using a stair climbing machine. Moreover, an exercise machine conforming to aspects of the present invention provides additional health benefits that are not recognized by a treadmill or stair climbing machine alone. These and numerous other embodiments and aspects of the present invention are discussed in a greater detail below.

Aspects of the present invention involve a resistance system used with dual deck treadmill exercise devices having two treadles or treadle assemblies pivotally connected with a frame. In particular, the resistance system is adapted resist pivotal movement of the treadles. As discussed in more detail below, the treadles may pivot up and down about a common axis or in the region of a common axis. In use, a user can walk, jog, or run on the treadles and the treadles will pivotally reciprocate about the common axis. The resistance system is operably connected with the treadle assemblies to resist up and down pivotal movement. As discussed below, the resistance system can include a drive shaft operably connected with a load source that resists rotation of the drive shaft. As the treadles pivot up and down, the treadles cause the drive shaft to rotate against the resistance imparted by the load source. Although the load source is described herein as an alternator or alternator resistance source, it is to be appreciated that the load source can be configured differently in other embodiments.

An exercise device conforming to the present invention may be configured to provide a user with a walking-type exercise, a stepping-type exercise, or a climbing-like exercise that is a combination of both walking and stepping. The exercise device generally includes two treadle mill-like assemblies (referred to herein as "treadle" or a "treadle assembly") pivotally connected with a frame so that the treadles may pivot up and down about a common axis. Each treadle includes a tread belt that provides a moving surface like a treadmill. In use, a walker will walk, jog or run on the treadles and the treadles will reciprocate about a common axis. The treadles may be interconnected so that upward movement is accompanied by downward movement of another treadle. The combination of moving surfaces of the treadle belts and the coordination and interconnected reciprocation of the treadles provides an exercise that is similar to climbing on a loose surface, such as walking, jogging, running up a sand dune where each upward and forward foot movement is accompanied by foot slippage backward and downward. Extraordinary cardiovascular and other health benefits are achieved by such a climbing-like exercise. Moreover, as will be recognized from the following discussion, the extraordinary health benefits are achieved in a low impact manner.

FIG. 1 is a diagrammatic view of one example of an exercise device 10 conforming to the present invention. The embodiment of the exercise device 10 illustrated in FIG. 1 includes protective and decorative panels which, in some instances, obscure the view of some components of the exercise device 10.

Figure 2:
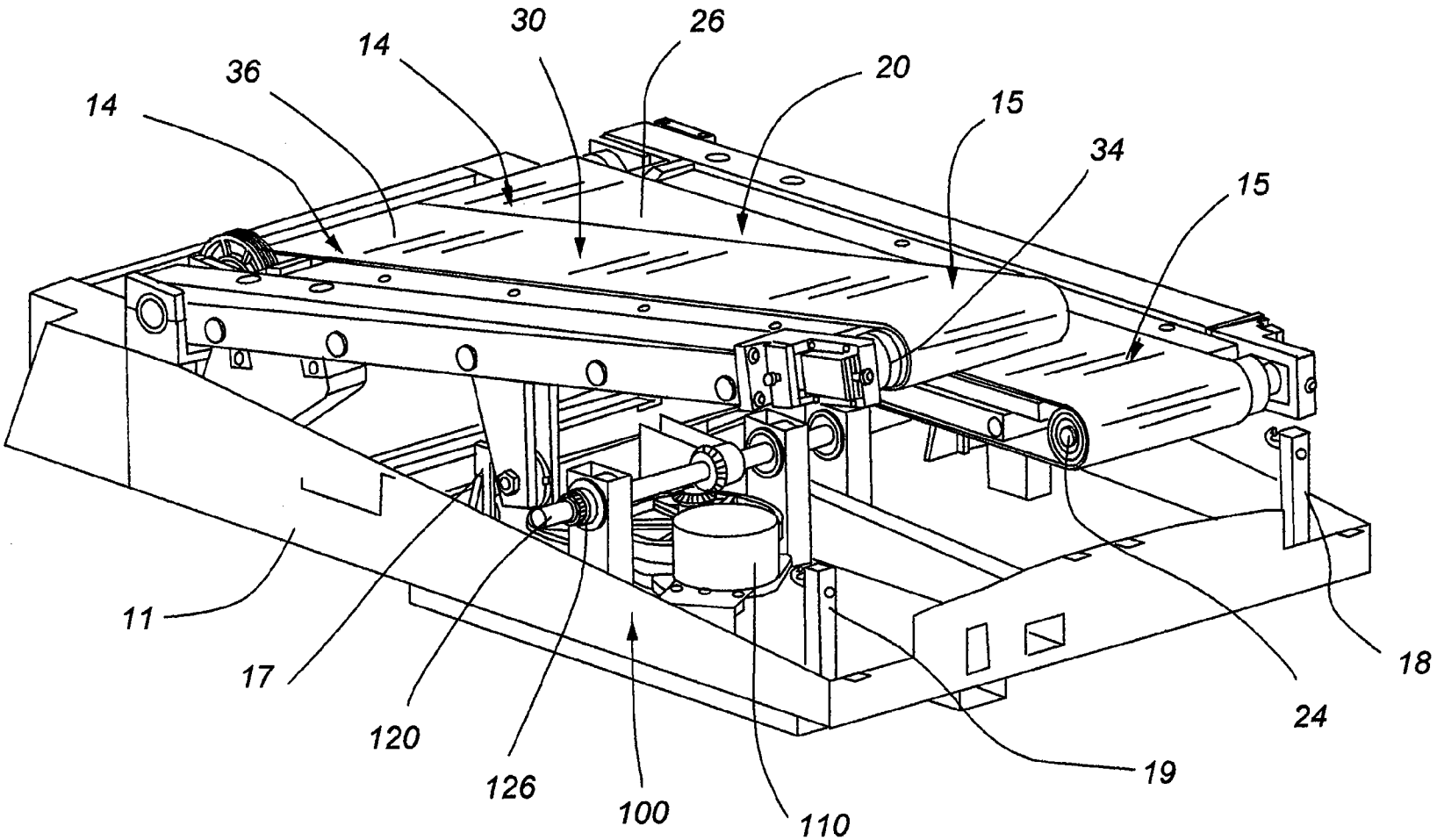
FIG. 2 is a front right diagrammatic view of a dual deck treadmill exercise device of FIG. 1 shown without a handle bar assembly 12 and console 13.

FIG. 2 is a right front diagrammatic view of the exercise device 10 illustrated in FIG. 1 shown with a handle bar assembly 12, console 13, the protective and decorative panels removed to better illustrate all the components of the device 10.

Figure 3:
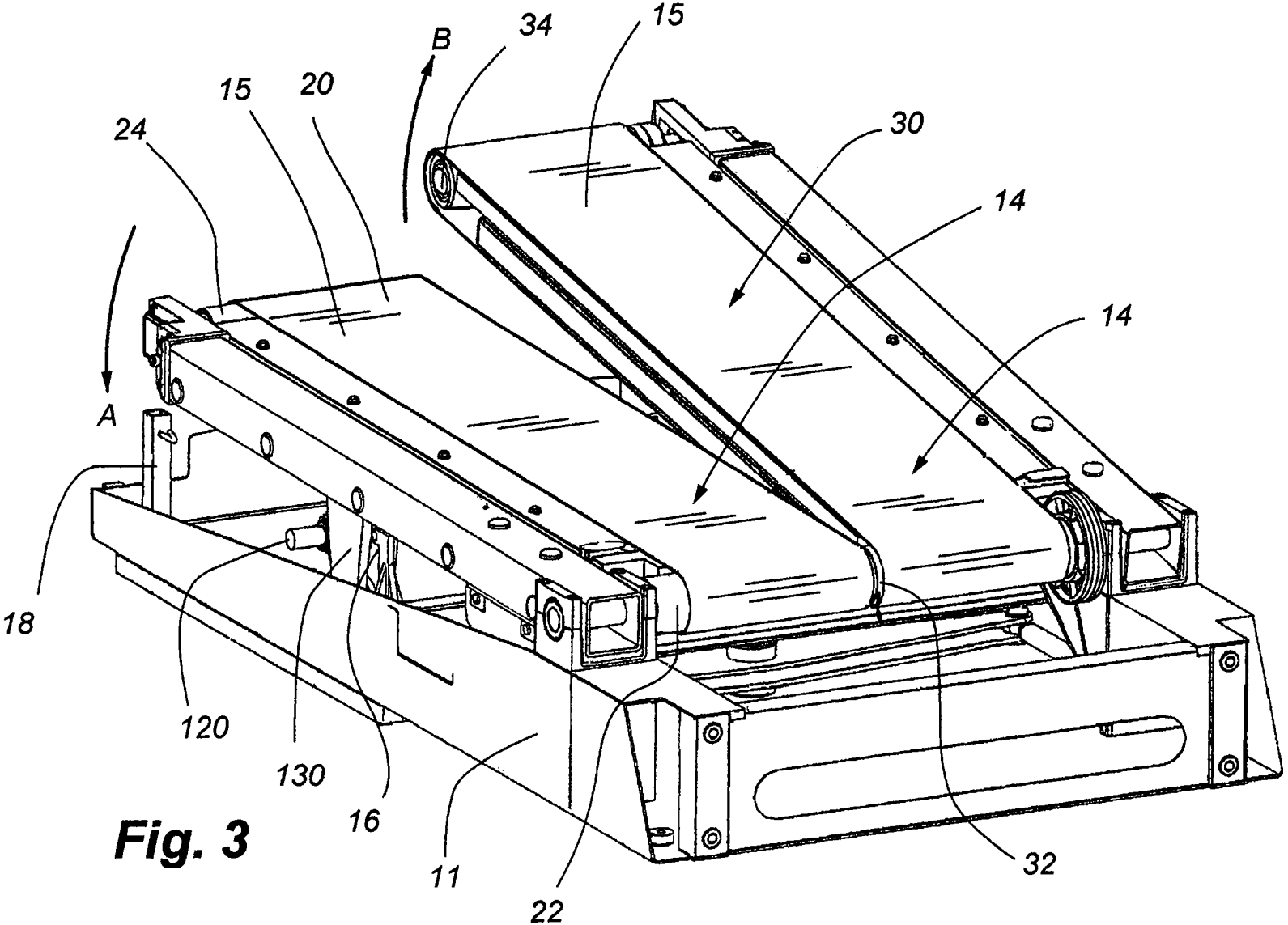
FIG. 3 is a left rear diagrammatic view of the dual deck treadmill exercise device of FIG. 2.

FIG. 3 is a left rear diagrammatic view of the exercise device 10 of FIG. 2.

As shown in FIGS. 1-3, and one form of an exercise device 10 utilizing a resistance system 100 conforming aspects of the present invention. The exercise device 10 includes a first treadle assembly 20 and a second treadle assembly 30, each having a front portion 15 and a rear portion 14. The rear portion 14 of the treadle assemblies 20, 30 are pivotally supported at a rear of the exercise device 10. The front portions 15 of the treadle assemblies 20, 30 are supported above the frame 11, and are configured to reciprocate in a generally upward and downward manner during use. It is also possible to pivotally support the treadles 20, 30 at the front of the exercise device 10, and support the rear of the treadle assemblies 20, 30 above the frame 11. The treadle assemblies 20, 30 also support an endless belt or treadle belt 26, 36 that rotates over a deck and about front and rear rollers 24, 34 and 22, 32 to provide either a forward or rearward moving surface.

A user may perform exercise on the device 10 facing toward the front of the treadle assemblies 20, 30 (referred to herein as "forward facing use") or may perform exercise on the device 10 facing toward the rear of the treadle assemblies 20, 30 (referred to herein as "rearward facing use"). The term "front," "rear" and "right" are used herein with perspective of a user standing on the device 10 in a forward-facing manner that the device 10 will be typically be used. During any method of use, the user will walk, jog or run and/or step on the exercise device 10 in a manner where each of the user's feet contact one of the treadle assemblies 20, 30. For example, in forward-facing use the user's left foot will typically only contact the left treadle assembly and the user's right foot will typically only contact the right treadle assembly. Alternatively, in rearward facing use, the user's left foot will typically only contact the right treadle assembly and the user's right foot will typically only contact the left treadle assembly.

An exercise device conforming to aspects of the invention may be configured to only provide a striding motion or to only provide a stepping motion. For a striding motion, the treadle assemblies 20, 30 are configured to not reciprocate and the endless belt 26, 36 configured to rotate. The term "striding motion" is meant to refer to any typical human striding motion, such as walking, jogging and/or running. For a stepping motion, the treadle assemblies 20, 30 are configured to reciprocate and the endless belts 26, 36 are configures to not rotate about the rollers. The term "stepping motion" is meant to refer to any typical stepping motion, such as when a human walks on stairs using a conventional stepper exercise device, walks up a hill, etc.

As mentioned above, the rear of each treadle assembly 20, 30 is pivotally supported at the rear of the exercise device 10. The front of each treadle assembly 20, 30 is supported above the front portion 15 of the exercise device 10 so that the treadle assemblies 20, 30 may pivot upward and downward. When the user steps on the treadle belt 26, 36, the associated treadle assembly 20, 30, including the belt 26, 36, will pivot downwardly. As will be described in greater detail below, the treadle assemblies 20, 30 may be connected such that the downward or upward movement of one treadle assembly will cause a respective upward or downward movement of the other treadle assembly. Thus, when the user steps on one belt, the associated treadle assembly will pivot downward while the other treadle assembly will pivot upward. With the treadle assemblies 20, 30 configured to move up and down and the treadle belt 26, 36 is configured to provide a moving striding surface, the user may achieve an exercise movement that encompasses a combination of walking and stepping. A left upright is connected with a forward end region of the left side member. A right upright is connected with a forward end region of the right side member. The uprights extend generally upward from the frame 11 with a slight rearward sweep. Handles extend transversely to the top of each upright in a generally T-shaped orientation with the upright. The top of the T is the handle and the downwardly extending portion of the T is the upright. The handles are arranged generally in the same plane as their respective underlying side members. The handles define a first section connected with the uprights and a second rearwardly section extending angularly oriented with respect to the first section. The handle is adapted for use to grasp during use of the exercise device 10. A console 13 is supported between the first sections of the handles. The console 13 includes one or more cup holders, an exercise display, one or more depressions adapted to hold keys, cell phone or other personal items. The console 13 is best shown in FIG. 1.

The front rollers 24, 34 are rotatably supported at the front of each treadle frame and the rear rollers 22, 32 are pivotally supported at the rear of each treadle frame. To adjust the treadle belt tension and tracking, the front or rear rollers may be adjustable connected with the treadle frame. Each roller can be adjustably connected with the front of each respective treadle frame. The front roller 24, 34 may include an axle extending outwardly from both ends of the roller.

The belt decks are located on the top of each treadle frame. The deck may be bolted to the treadle frame, may be secured to the frame 11 in combination with a deck cushioning or deck suspension system, or may be loosely mounted on the treadle frame. Each belt deck is located between the respective front and rear rollers of each treadle assembly 20, 30. The belt decks are dimensioned to provide a landing platform for most or all of the upper run of the treadle belts 26, 36.

The front of each treadle assembly 20, 30 may be supported above the frame 11 by one or more dampening elements, not shown, an interconnect member, not shown, or a combination thereof so that each treadle assembly 20, 30 may pivot up and down with respect to the lower frame. The rear of each treadle assembly 20, 30 is pivotally supported at the rear of the frame 11 by a resistance system 100 to provide resistance or dampening of the downward movement of the treadles 20, 30. When the user steps on a treadle, the treadle (including the belt) will pivot downwardly. As will be described in greater detail below, the treadle assemblies 20, 30 may be interconnected such that downward or upward movement of one treadle assembly will cause a respective upward or downward movement of the other treadle assembly. Thus, when the user steps on one treadle, it will pivot downwardly while the other treadle assembly will pivot upwardly. With the treadle assemblies 20, 30 configured to move up and down and the tread belts 26, 36 configured to provide a moving striding surface, the user may achieve an exercise movement that encompasses a combination of striding and stepping.

Figure 4:
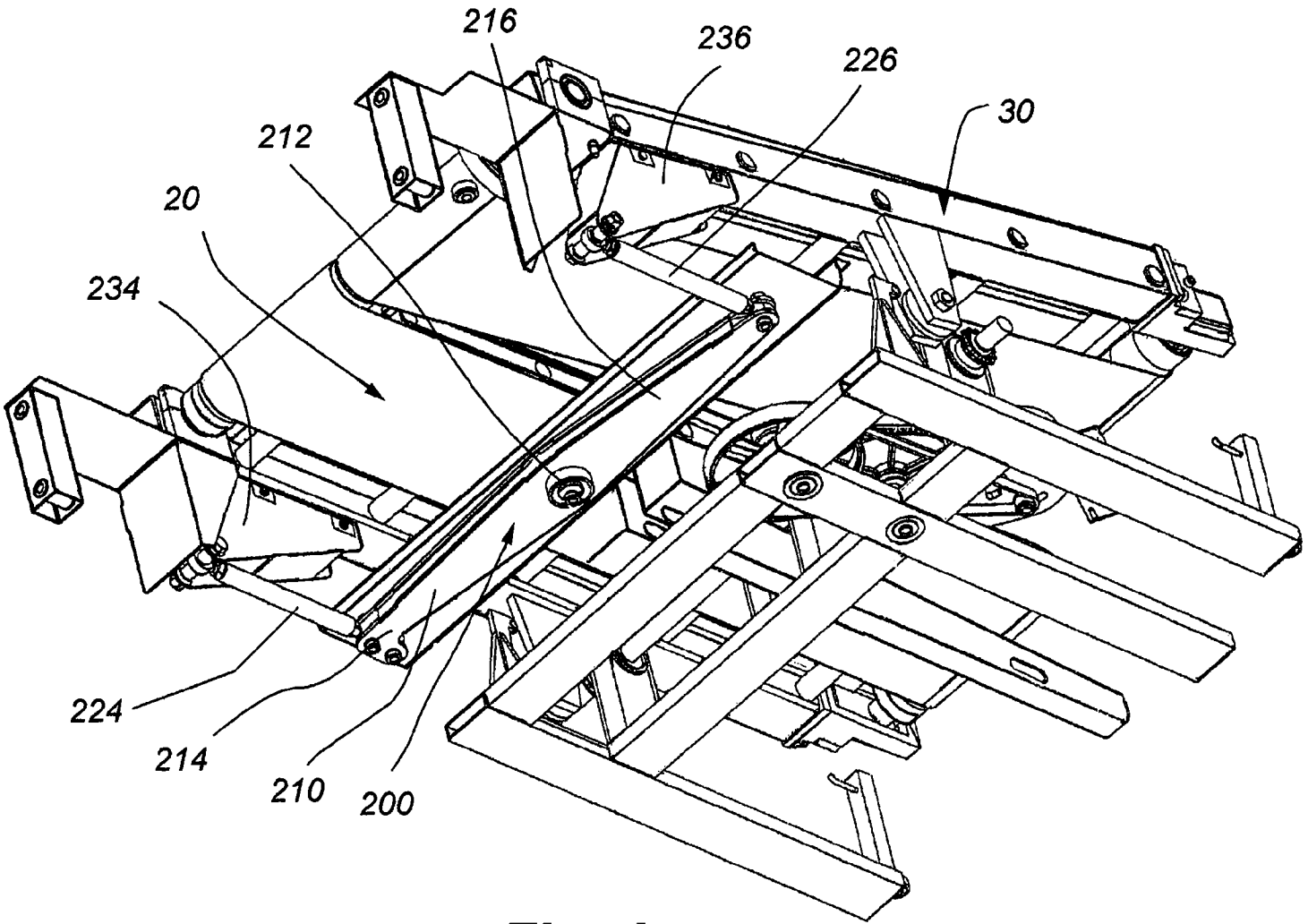
FIG. 4 is a bottom diametric/diagrammatic view of the dual deck treadmill exercise device of FIG. 2 showing an interconnection assembly.

FIG. 4 is a bottom diagrammatic view of the dual deck treadmill exercise device 10 of FIG. 2 showing an interconnect assembly. To not unnecessarily block the view of the interconnect structure or assembly, the frame reel is not shown in FIG. 4. Other components of the exercise device 10 are also not shown in FIG. 4 to not unnecessarily hide the view of various features of the interconnect assembly 200. Some such interconnection assemblies are described in various applications incorporated by reference.

As shown in FIG. 4, the interconnect assembly 200 includes a teeter member 210 arranged to pivot in a horizontal plane about a vertical interconnect axle 212. The teeter member 210 is pivotally connected with a frame rail disposed below the teeter member 210. The teeter member 210 includes a first portion and a second portion such that the first portion and the second portion are opposing in regions 214, 216 of the teeter member 210 with respective treadle assemblies 20, 30. More particularly, the first end region 214 of the teeter member 210 is coupled to one end portion of a first tie rod 224. An opposing end portion of the first tie rod 224 is pivotally connected with a first interconnect bracket 234 extending downward from the first treadle assembly 20. The second end region 216 of the teeter member 210 is pivotally connected with one end portion of a second tie rod 226. The second tie rod 226 is pivotally connected with a second interconnect bracket 236 extending downward from the second treadle assembly 30.

In use, as one treadle pivots it causes the associated interconnect bracket 234, 236 to pivot backward and frontward. Pivotal actuation of one treadle causes the associated interconnect bracket 234, 236 to pivot back and forth. The back and forth movement of the interconnect bracket 234, 236 pulls and pushes on the respective end of the teeter member 210 causing an opposite movement of the other end of the teeter member 210 as the teeter member 210 pivots about the vertical interconnect axle 212. As such, downward pivotal movement of one treadle is accompanied by upward pivotal movement of the opposing treadle, and vice versa. As mentioned above, the teeter member 210 is arranged to pivot in a substantially horizontal plane. In other embodiments, the teeter member 210 is arranged to pivot in a substantially vertical plane. It is also possible to orient the interconnect axle 212 in various planes to position the teeter member 210 to pivot in planes between horizontal and vertical, i.e., angular planes.

Figure 5:
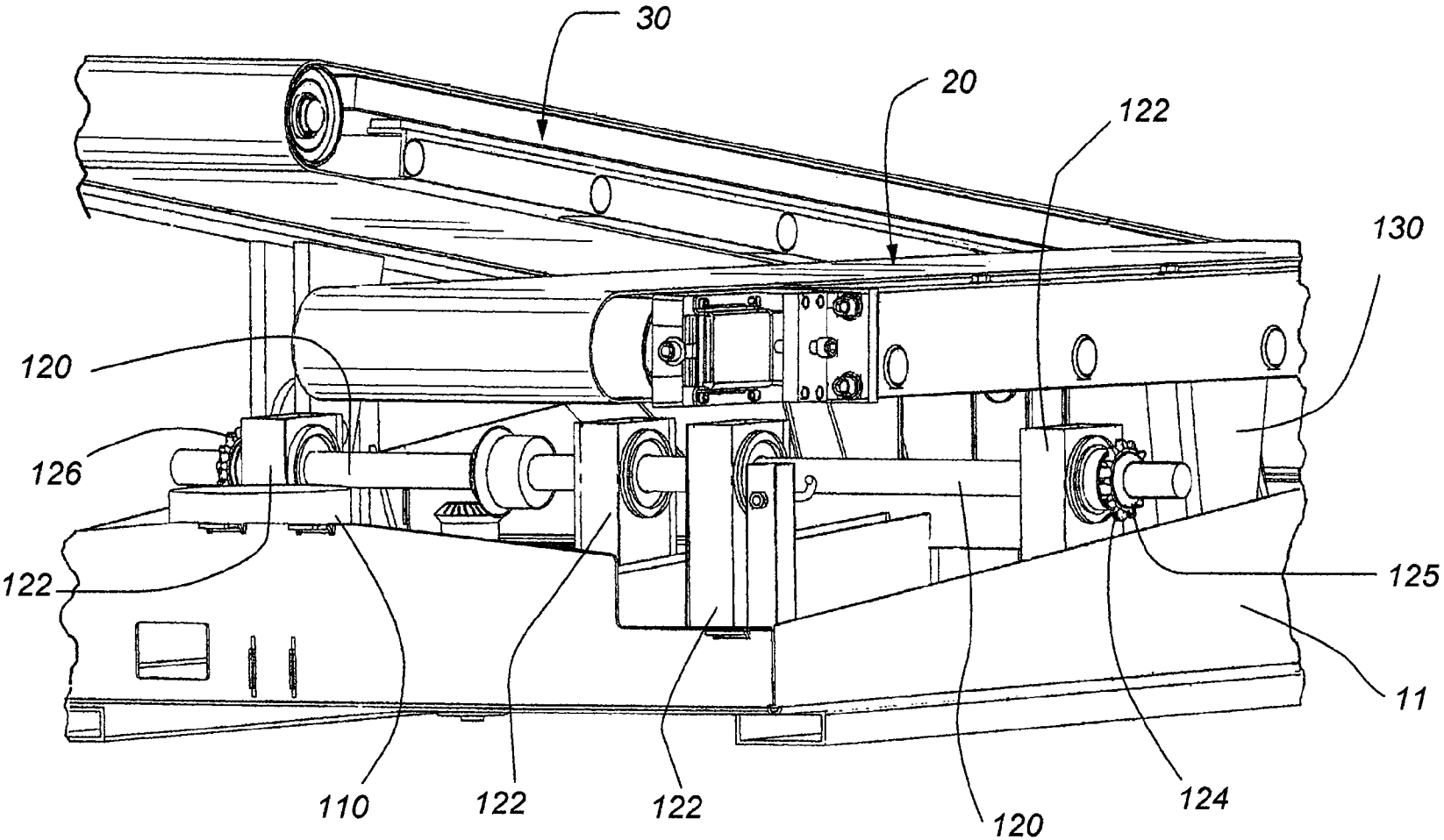
FIG. 5 is a left diametric view of a resistance system on the dual deck treadmill exercise device of FIG. 2.
Figure 6:
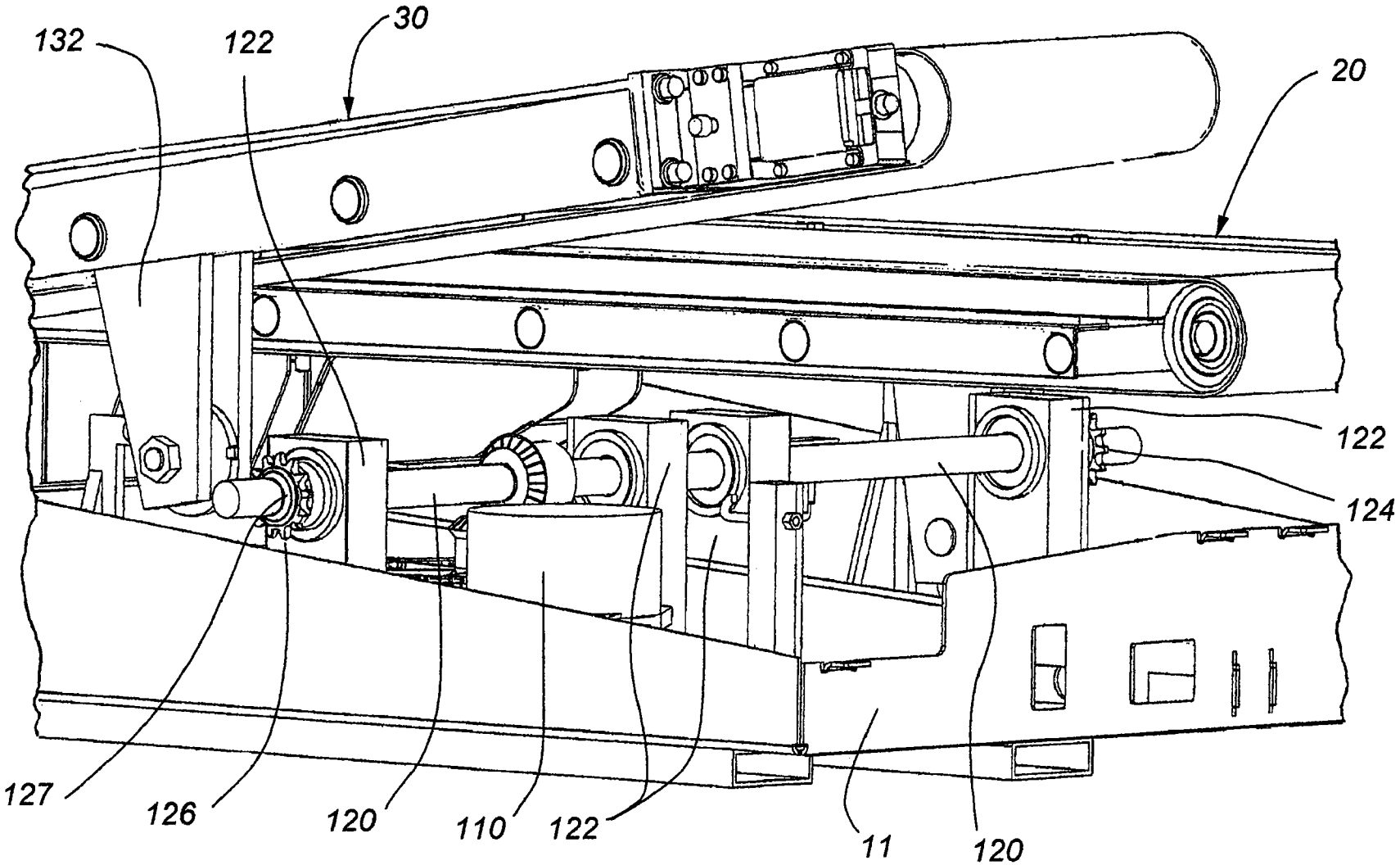
FIG. 6 is a right diametric view of a resistance system of the dual deck treadmill exercise device of FIG. 2.

FIG. 5 is a detailed view of the resistance system 100 on the dual deck treadmill exercise device 10 of FIG. 2. FIG. 6 is a detailed view of the resistance system 100 on the dual deck treadmill exercise device 10 of FIG. 2.

As previously mentioned, the resistance system 100 of the exercise device 10 is operably connected with the treadle assemblies 20, 30 to resist pivotal movement. As shown in FIGS. 2, 5 and 6, the resistance system 100 includes a drive shaft 120, a load source 110, a transmission assembly 300, drive sprockets 124, 126, one-way bearings 125, 127 and a connecting driving member. The drive shaft 120 is operably connected with the load source 110 through the transmission assembly 300. The load source 110, shown in the form of an alternator or alternator resistance source, may be adapted to resist rotation of the drive shaft 120. Drive sprockets 124, 126 may be connected with opposing portions of the drive shaft 120 through the one-way bearings. As is discussed in more detail below, the treadles 20, 30 may be operably connected with the drive sprockets 124, 126 through the driving member. As the treadles 20, 30 pivot up and down, the treadles 20, 30 may move the chains 154, 156 along the drive sprockets 124, 126, causing the drive shaft 120 to rotate against the resistance imparted by the load source.

Figure 11:
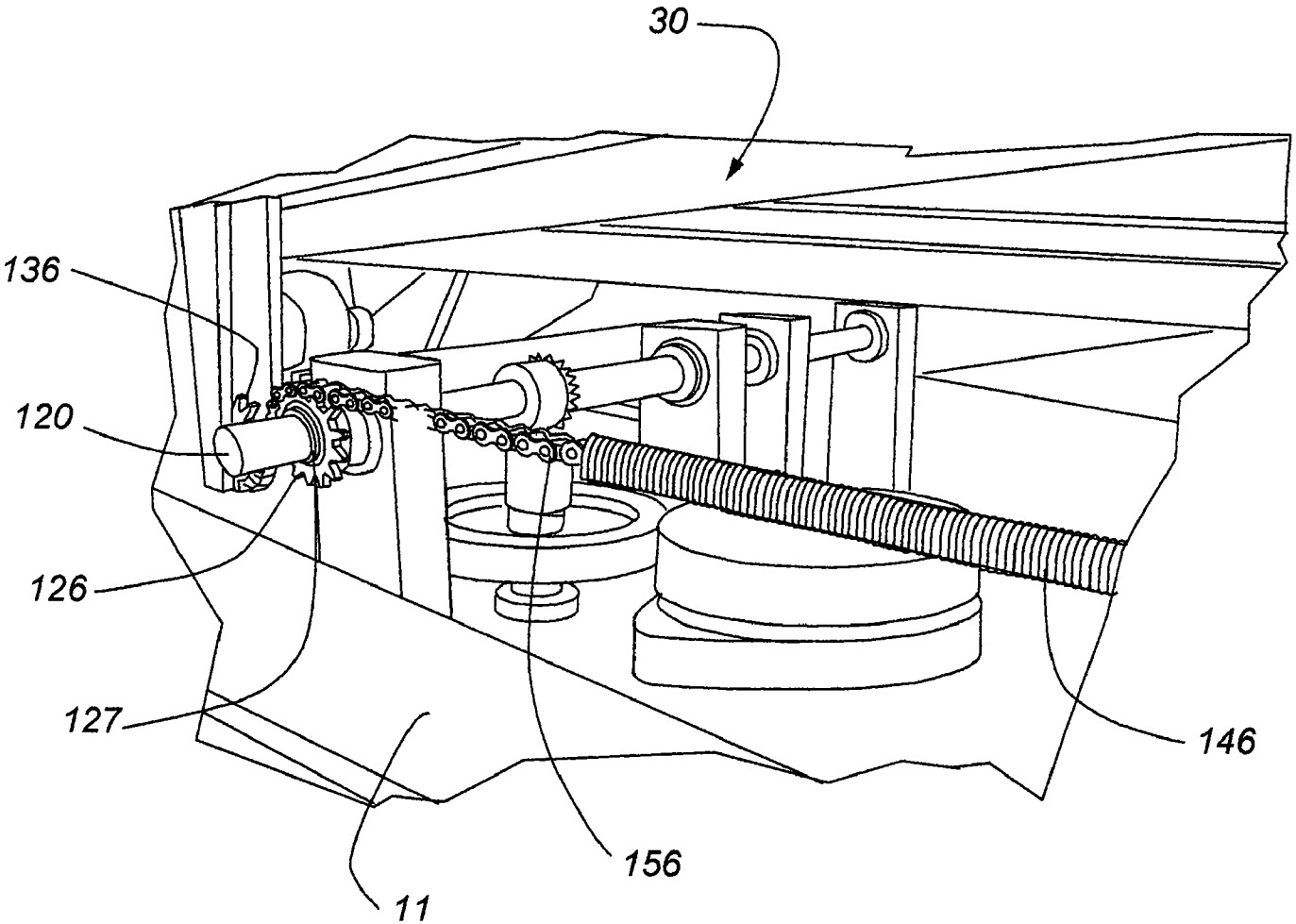
FIG. 11 is a diagrammatic view of the resistance system operably connecting a second treadle with the drive shaft.

As previously mentioned, downward movement of the treadles 20, 30 causes the drive shaft 120 to rotate against the rotational resistance exerted by the alternator resistance source 110. As shown in FIGS. 2, 5 and 6, the drive shaft 120 may be rotatably supported by at least one support member 122. For example, as illustrated in the figures, the draft shaft 120 may be supported by four support members 122 connected with and extending upward from a bottom of the frame 11. A first drive sprocket 124 is connected with a first end portion of the drive shaft 120 through a first one-way bearing 125 (FIGS. 5, 7 and 8), and a second drive sprocket 126 is connected with a second end portion of the drive shaft 120 through a second one-way bearing 127 (FIGS. 6 and 11). The first drive sprocket 124 and the first one-way bearing may be seated about or near the first treadle 20. The second drive sprocket 126 and one-way bearing may be seated about or near the second treadle 30. When the drive sprockets 124, 126 are rotated in a first direction (i.e. a drive direction), the one-way bearings operate to connect the drive sprockets 124, 126 with the drive shaft 120 such that the drive shaft 120 rotates with the drive sprockets 124, 126. When the drive sprockets 124, 126 are rotated in an opposite second direction (i.e. a free wheel direction), the one-way bearings allow the drive sprockets 124, 126 to free wheel and rotate relative to the drive shaft 120. As discussed in more detail below, downward pivotal movement of the first treadle 20 causes the first drive sprocket 124 to rotate in the drive direction, which in turn, causes the drive shaft 120 to rotate. Similarly, downward pivotal movement of the second treadle 30 causes the second drive sprocket 126 to rotate in the drive direction, which in turn, causes the drive shaft 120 to rotate. In addition, as the treadles 20, 30 pivot upward, the one-way bearings allow the respective drive sprockets 124, 126 to free wheel and rotate relative to the drive shaft 120.

Figure 7:
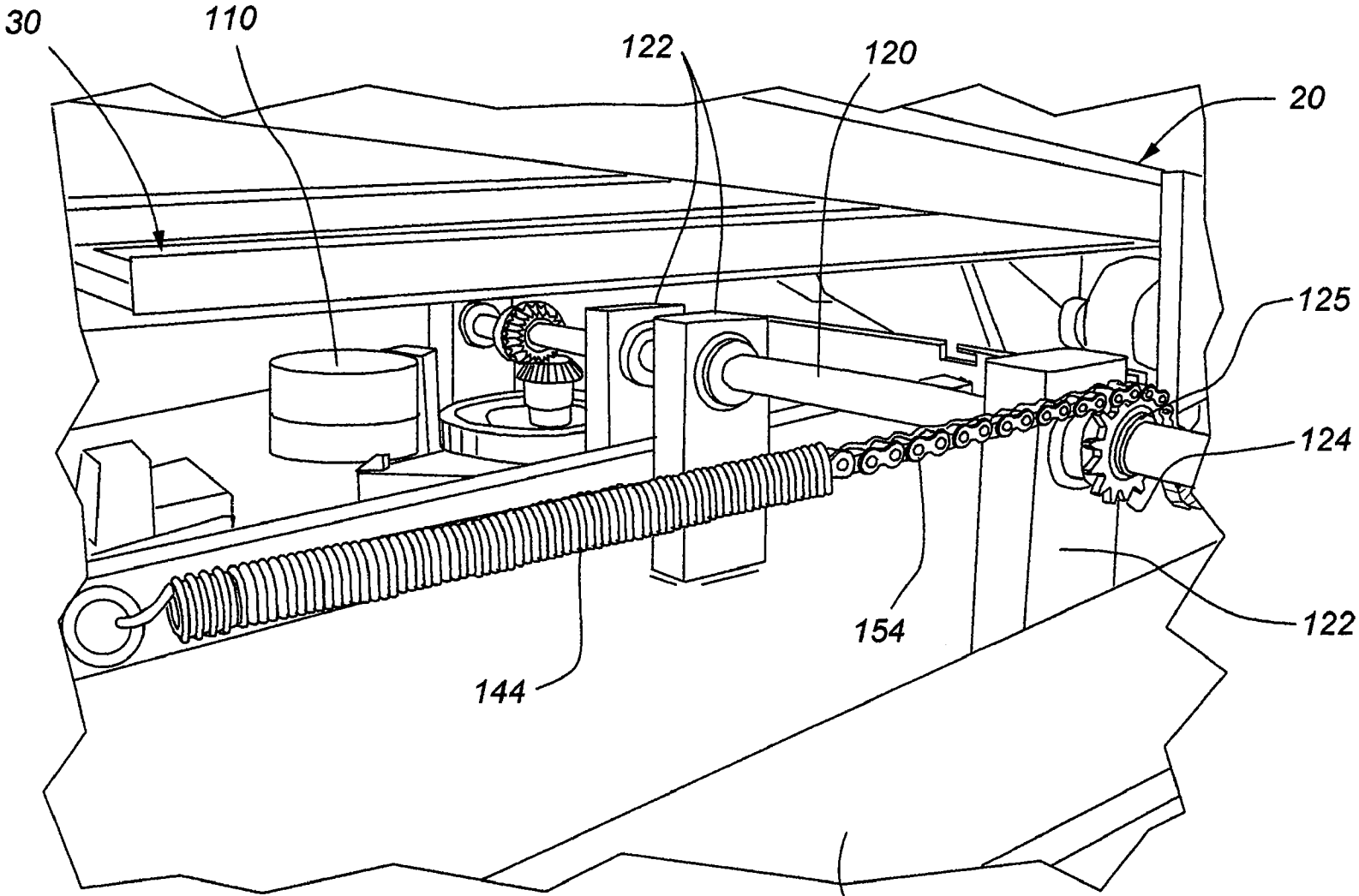
FIG. 7 is a left diametric view of a resistance system on the dual deck treadmill exercise device of the present invention.
Figure 8:
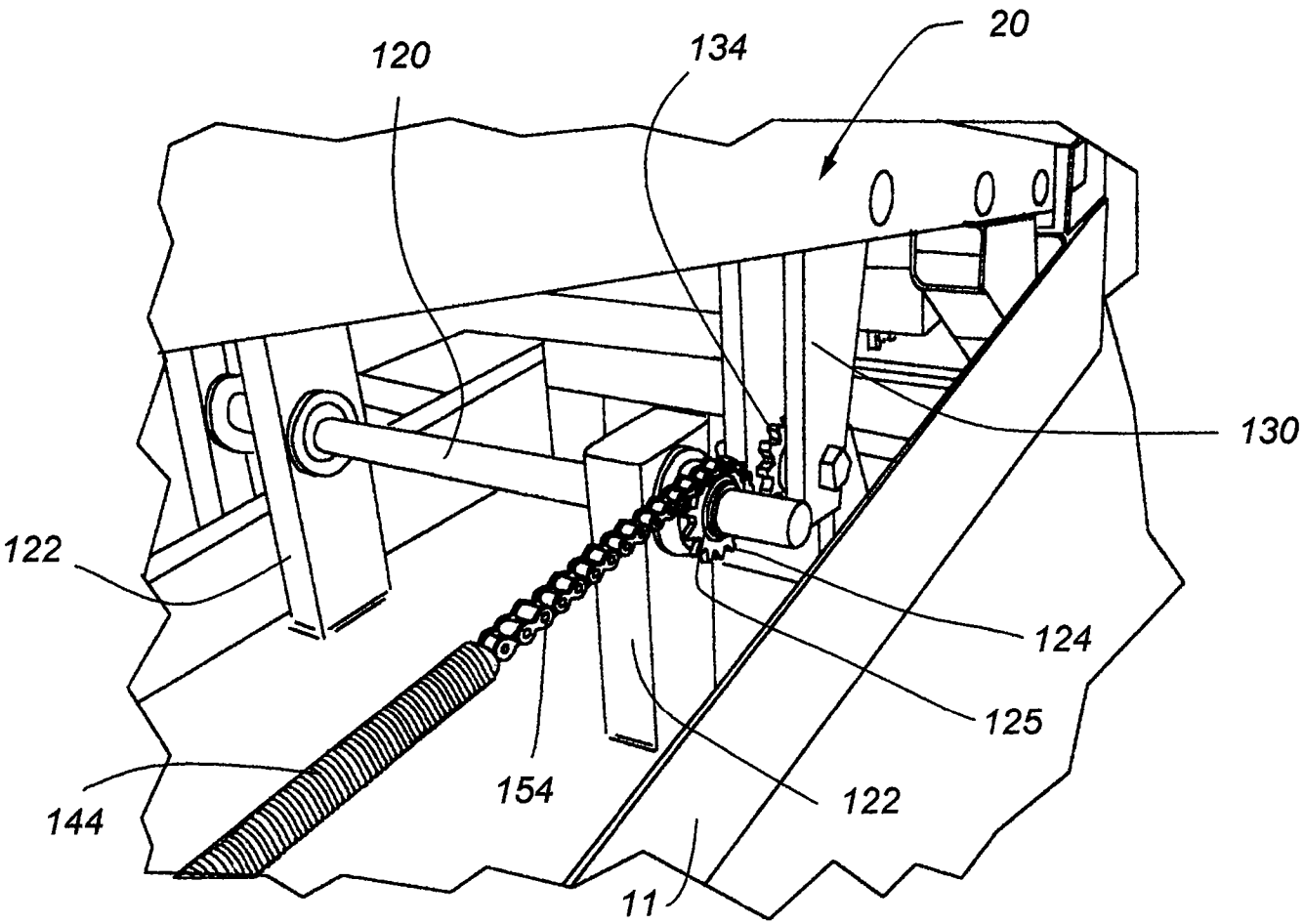
FIG. 8 is a diametric view of a sprocket chain and spring component of the resistance system on the dual deck treadmill exercise device of FIG. 2.
Figure 9:
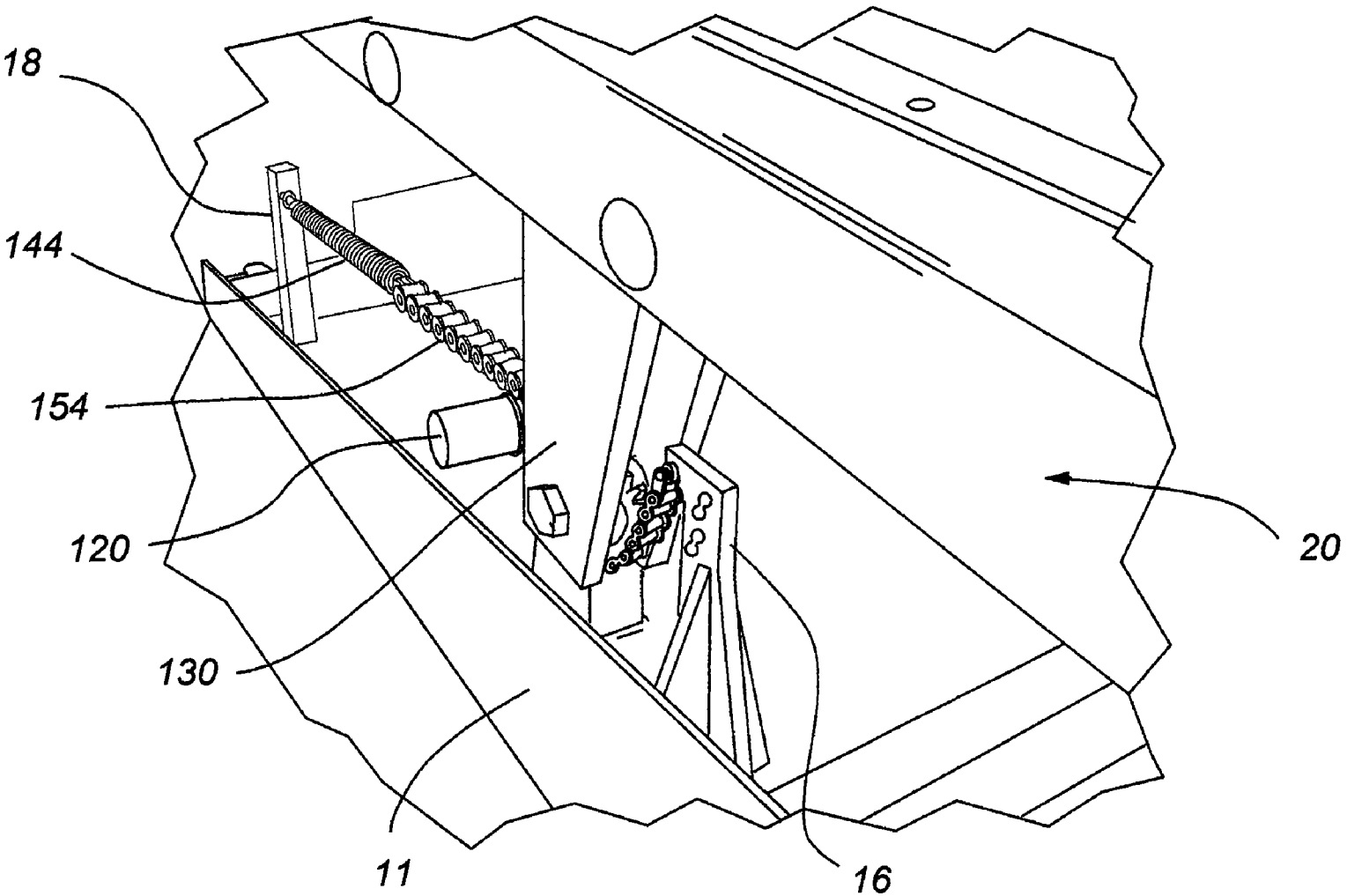
FIG. 9 is a right side diagrammatic view of various components operably connecting a first treadle with a drive shaft.
Figure 10:
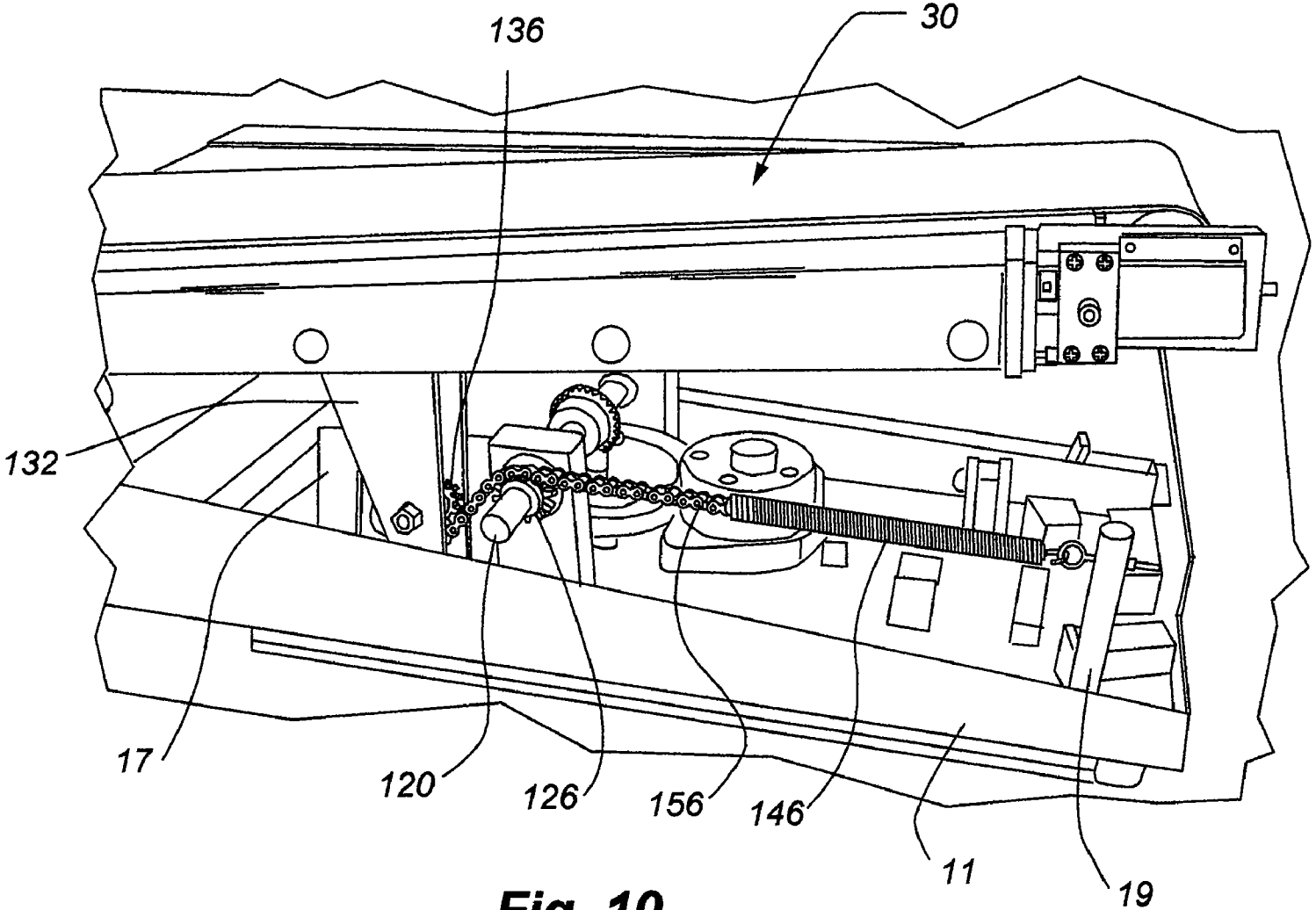
FIG. 10 is a right side diagrammatic view of the resistance system on the dual deck treadmill device of FIG. 2.
Figure 12:
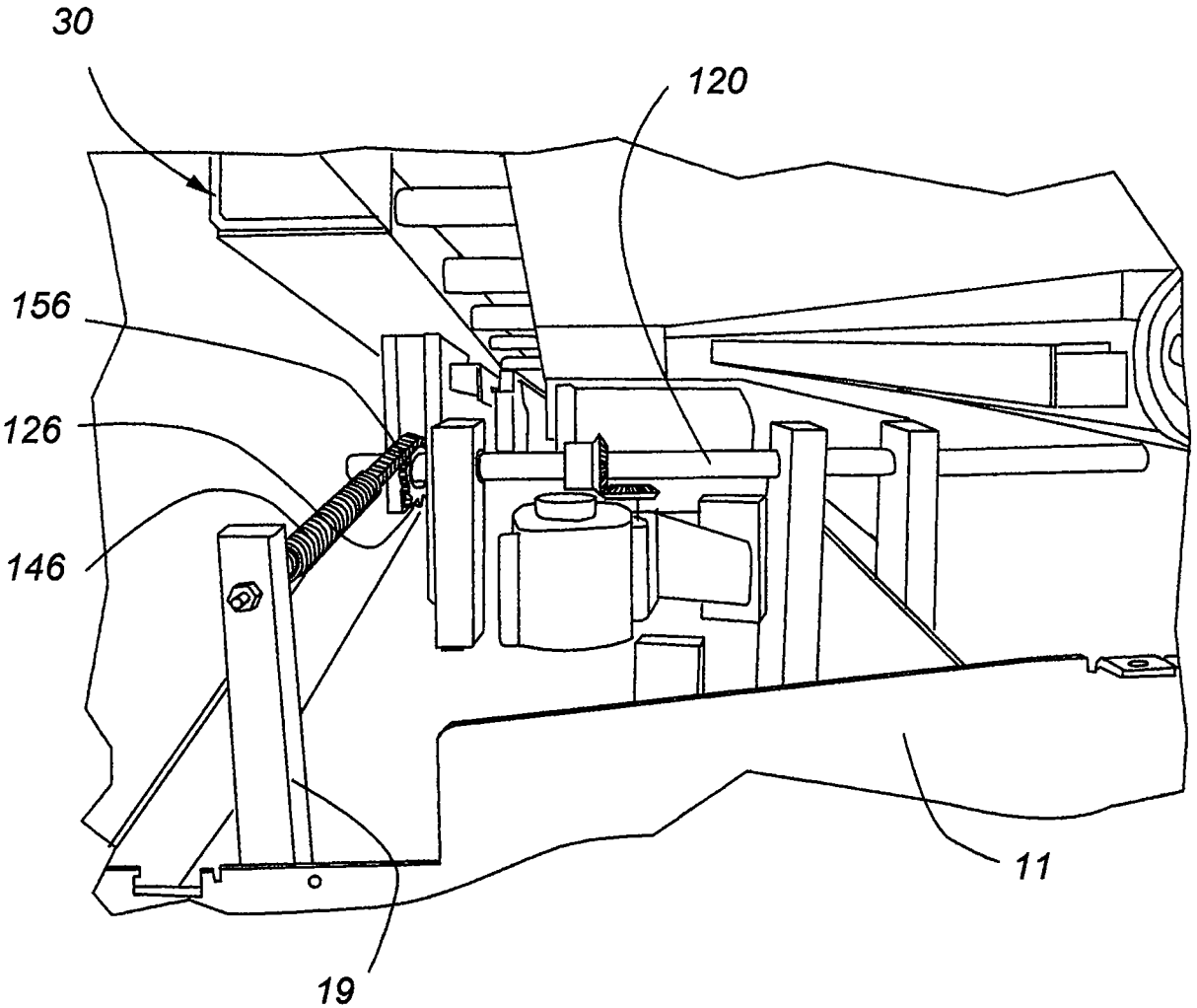
FIG. 12 is a diagrammatic view of the drive shaft of the resistance system for the dual deck treadmill exercise of FIG. 2.

FIGS. 7-9 is a rear left diagrammatic view showing various components operably connecting the first treadle 20 with the drive shaft 120. FIGS. 10-12 show diametric views showing various components operably connecting a second treadle 30 with the drive shaft 120. More specifically, in FIGS. 7-9 a first chain 154 is connected to the first drive sprocket 124 on the drive shaft 120.

As mentioned above, the treadles 20, 30 may be operably connected with the drive sprockets 124, 126 through chains 154, 156. Downward pivotal movement of the treadles 20, 30 moves the chains 154, 156 along the drive sprockets 124, 126, causing the drive shaft 120 to rotate. As shown in FIGS. 7-12 and others, the resistance system 100 may include first and second chains 154, 156 and first and second springs 144, 146 connected with the frame 11. Referring to FIGS. 7-9 and others, an end portion of the first chain may be connected with a first rear support 16 extending upward from the bottom of the frame 11. From the first rear support 16, the first chain extends in a forward direction, engaging teeth on the first drive sprocket 124. From the first drive sprocket 124, the first chain may extend to an opposing end portion connected with an end portion of the first spring 144. In turn, an opposing end portion of the first spring 144 may be connected with a first front support 18 extending upward from the bottom of the frame 11. As discussed below, the first treadle 20 may be adapted to engage the first chain to rotate the first sprocket 124 in the drive direction as the first treadle 20 pivots downward. The first spring 144 stretches as the first treadle 20 pivots downward, allowing the first chain 154 to move and rotate first sprocket 124 in the drive direction. As the first treadle 20 pivots upward, the first spring 144 may contract and pull the first chain 154 along first sprocket 124, rotating the first sprocket 124 in the free wheel direction.

The second chain 156 and spring 146 may be arranged similarly as the first chain 154 and spring 144. As shown in FIGS. 10-12 and others, an end portion of the second chain 156 may be connected with a second rear support 17 extending upward from the bottom of the frame 11. From the second rear support 17, the second chain 156 extends in a forward direction, engaging teeth on the second drive sprocket 126. From the second drive sprocket 126, the second chain 156 may extend to an opposing end portion connected with an end portion of the second spring 146. In turn, an opposing end portion of the second spring 146 may be connected with a second front support 19 extending upward from the bottom of the frame 11. As discussed below, the second treadle 30 may be adapted to engage the second chain 156 to rotate the second sprocket 126 in the drive direction as the second treadle 30 pivots downward. The second spring 146 may stretch as the second treadle 30 pivots downward, allowing the second chain 156 to move and rotate second sprocket 126 in the drive direction. As the second treadle 30 pivots upward, the second spring 146 may contract and pull the chain 156 along second sprocket 126, rotating the second sprocket 126 in the free wheel direction. The first and second springs 144, 146 may also maintain tension in the first and second chains 154, 156 to help hold the chains 154, 156 in engagement with respective sprockets 124, 126.

As shown in FIGS. 7-12 and others, first and second treadle sprockets 134, 136 may be rotatably connected with sprocket brackets 130, 132 extending downward from the first and second treadles 20, 30, respectively. The first and second treadle sprockets 134, 136 may be positioned in engagement with the first and second chains 154, 156, respectively. In particular, teeth on the treadle sprockets 134, 136 may engage the chains 154, 156 between the rear supports 16, 17 and the drive sprockets 124, 126. As discussed in more detail below, when either treadle 20, 30 pivots downward, the associated treadle sprocket 134, 136 may push downward on the corresponding chain 154, 156, causing the spring 144, 146 to stretch. As the spring 144, 146 stretches, the chain 154, 156 may move along the corresponding drive sprocket 124, 126, causing the drive sprocket 124, 126 and drive shaft 120 to rotate together in the drive direction. Conversely, when either treadle 20, 30 pivots upward, the associated treadle sprocket 134, 136 may move upward, allowing the corresponding spring 144, 146 to retract and pull the chain 154, 156 along the drive sprocket 124, 126, which may cause the drive sprocket 124, 126 to rotate in the free wheel direction relative to the drive shaft 120.

Figure 13:
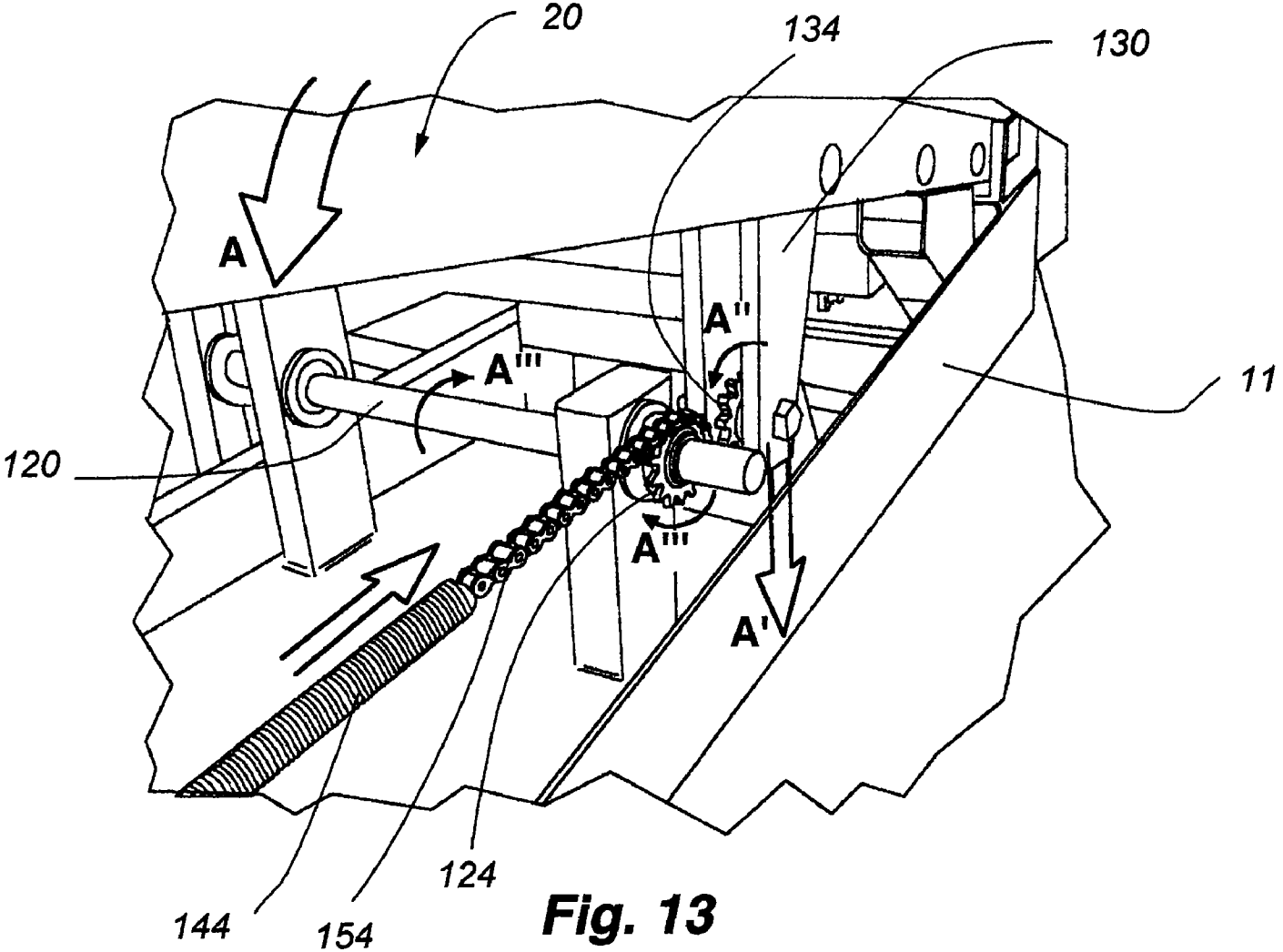
FIG. 13 is a detailed view showing directional movements of various components as the first treadle pivots downward.
Figure 14:
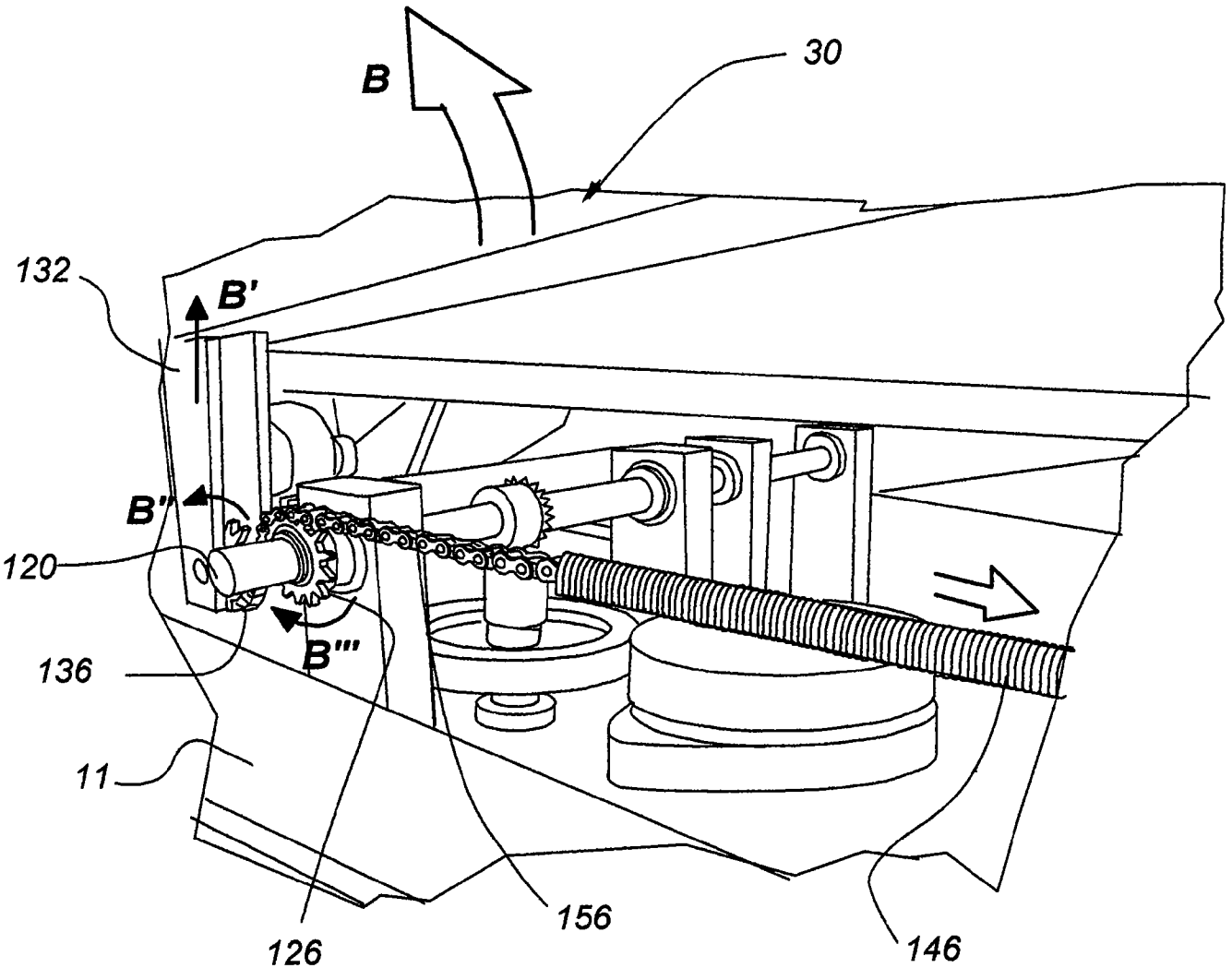
FIG. 14 is a detailed view showing a directional movement of various components as the second treadle pivots upward.
Figure 14A:
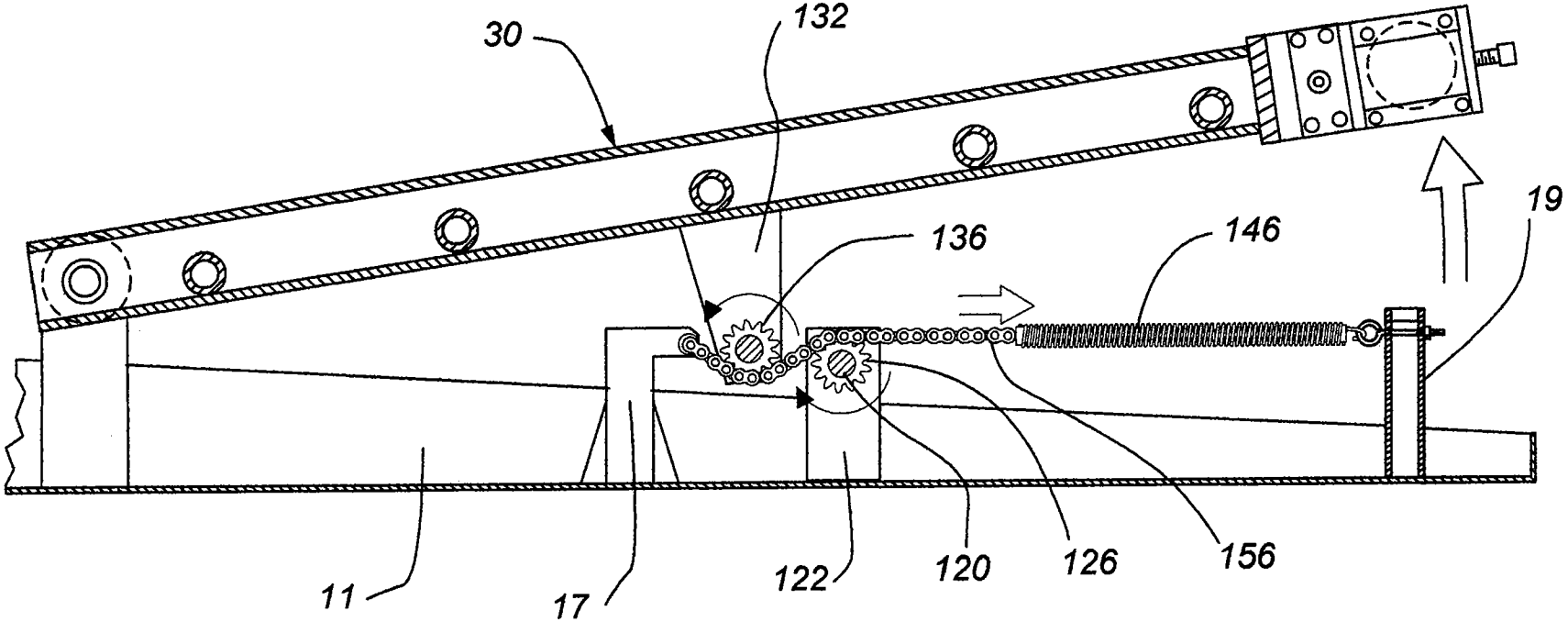
FIG. 14A is a side elevation view showing a directional movement of various components as the second treadle pivots upward.
Figure 14B:
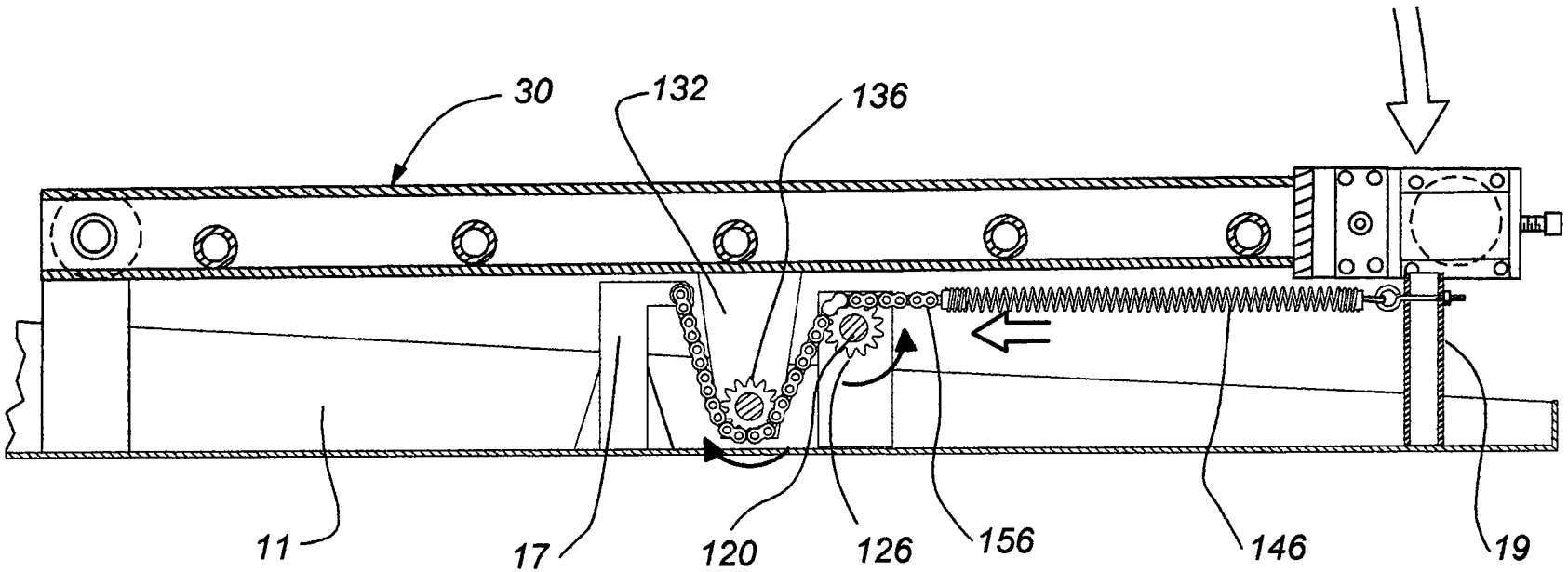
FIG. 14B is a side elevation view showing a directional movement of various components as the second treadle pivots downward.

FIG. 13 is a diagrammatic view showing directional movements of various components as the first treadle 20 pivots downward. FIGS. 14 and 14A are diagrammatic views showing directional movements of various components as the second treadle 30 pivots upward. FIG. 14B is a diagrammatic views showing directional movements of various components as the second treadle 30 pivots downward.

As previously mentioned, the drive shaft 120 is operably connected with the resistance source. FIGS. 15-20 and others show one embodiment of the resistance system 100 wherein the drive shaft 120 is operably connected with the resistance source through a transmission assembly 300 including an arrangement of gears, pulleys, and belts. It is be appreciated that other embodiments can include other various arrangements of sprockets and chains and/or various arrangements of gears or other transmission means. In addition, although the drive shaft 120 shown in FIGS. 15-20 is operably connected with the alternator resistance source 110 through a transmission, it is to be appreciated that in other embodiments, the drive shaft 120 is directly connected with the alternator resistance source 110. The arrangement of the resistance source and drive shaft 120 may vary based on the available vertical space beneath the treadles 20, 30 and optimum operating speed ranges for the resistance source.

Figure 15:
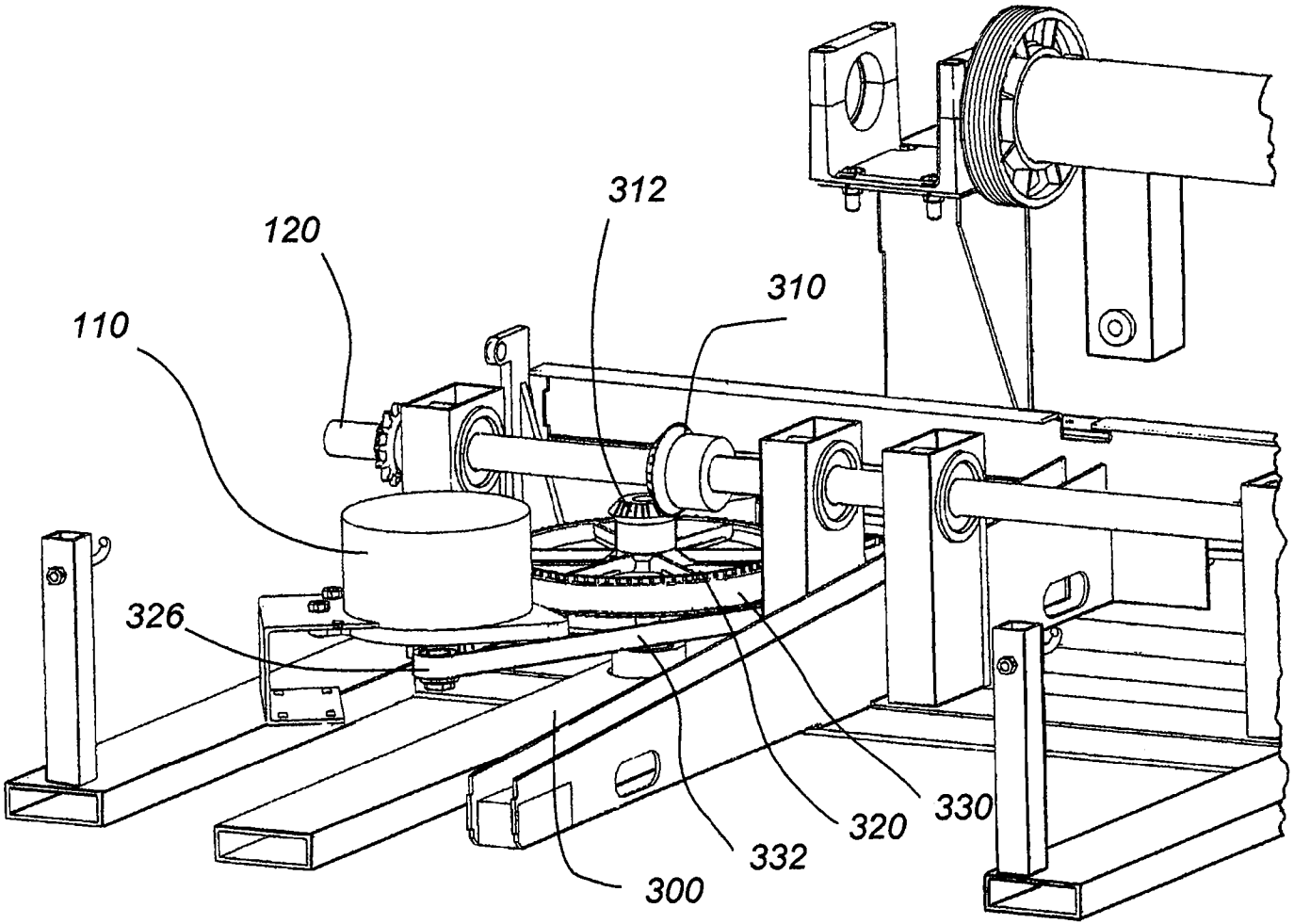
FIG. 15 is diagrammatic view of a transmission system operably connecting the drive shaft with an alternator without the treadles.
Figure 16:
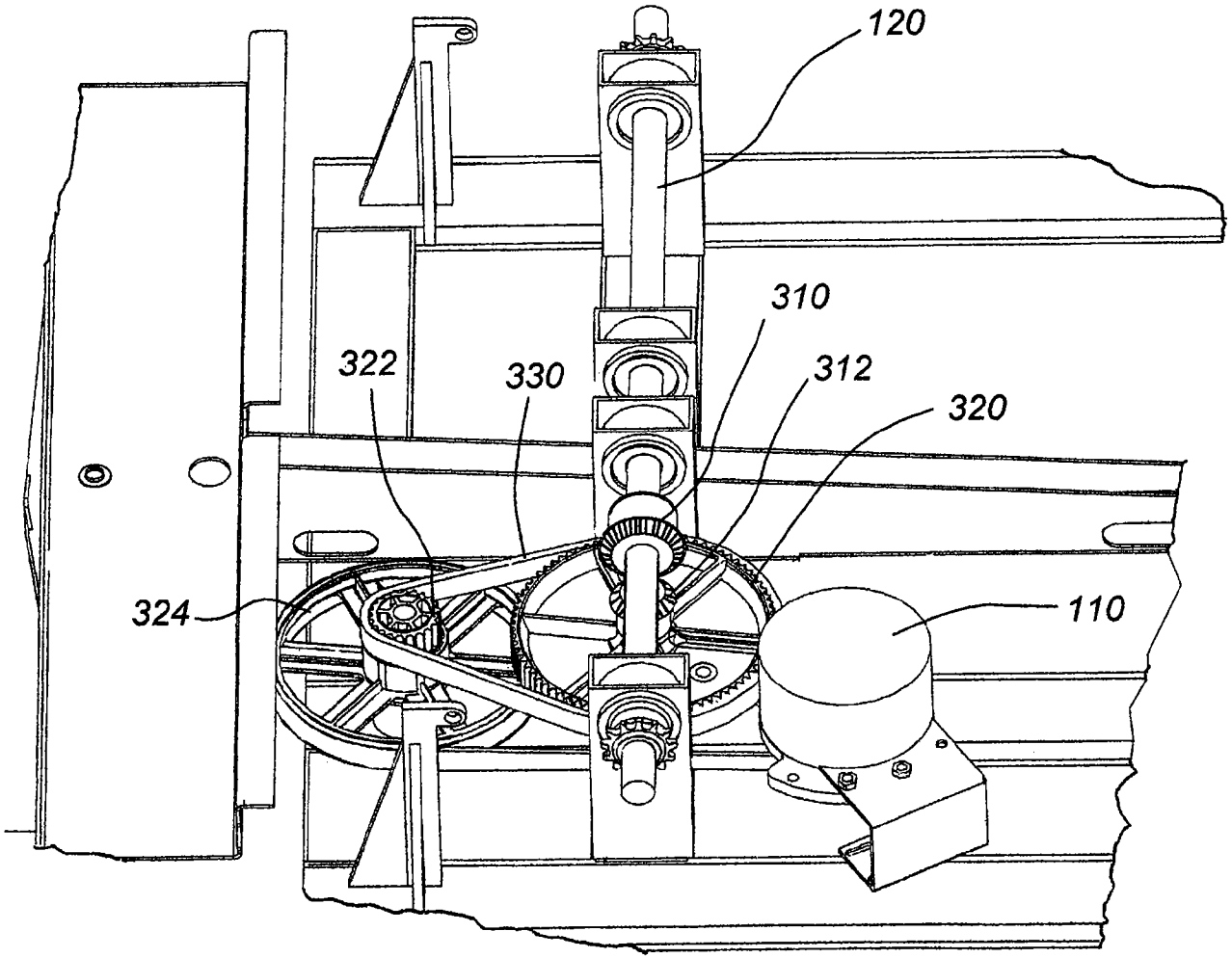
FIG. 16 is a diagrammatic view of the transmission assembly operably connecting the drive shaft with the alternator in FIG. 15.
Figure 17:
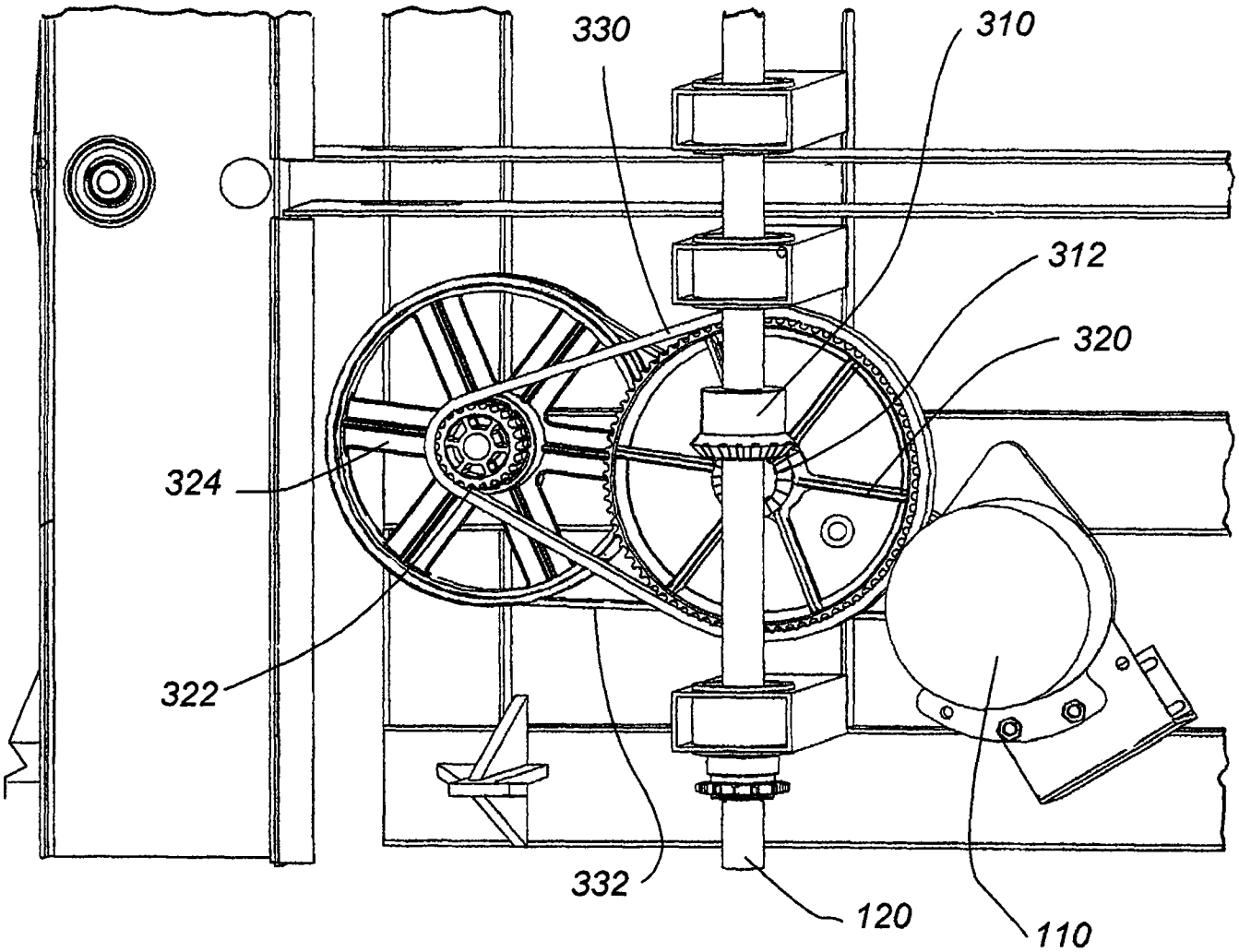
FIG. 17 is a top view of the transmission system shown in FIG. 15.
Figure 18:
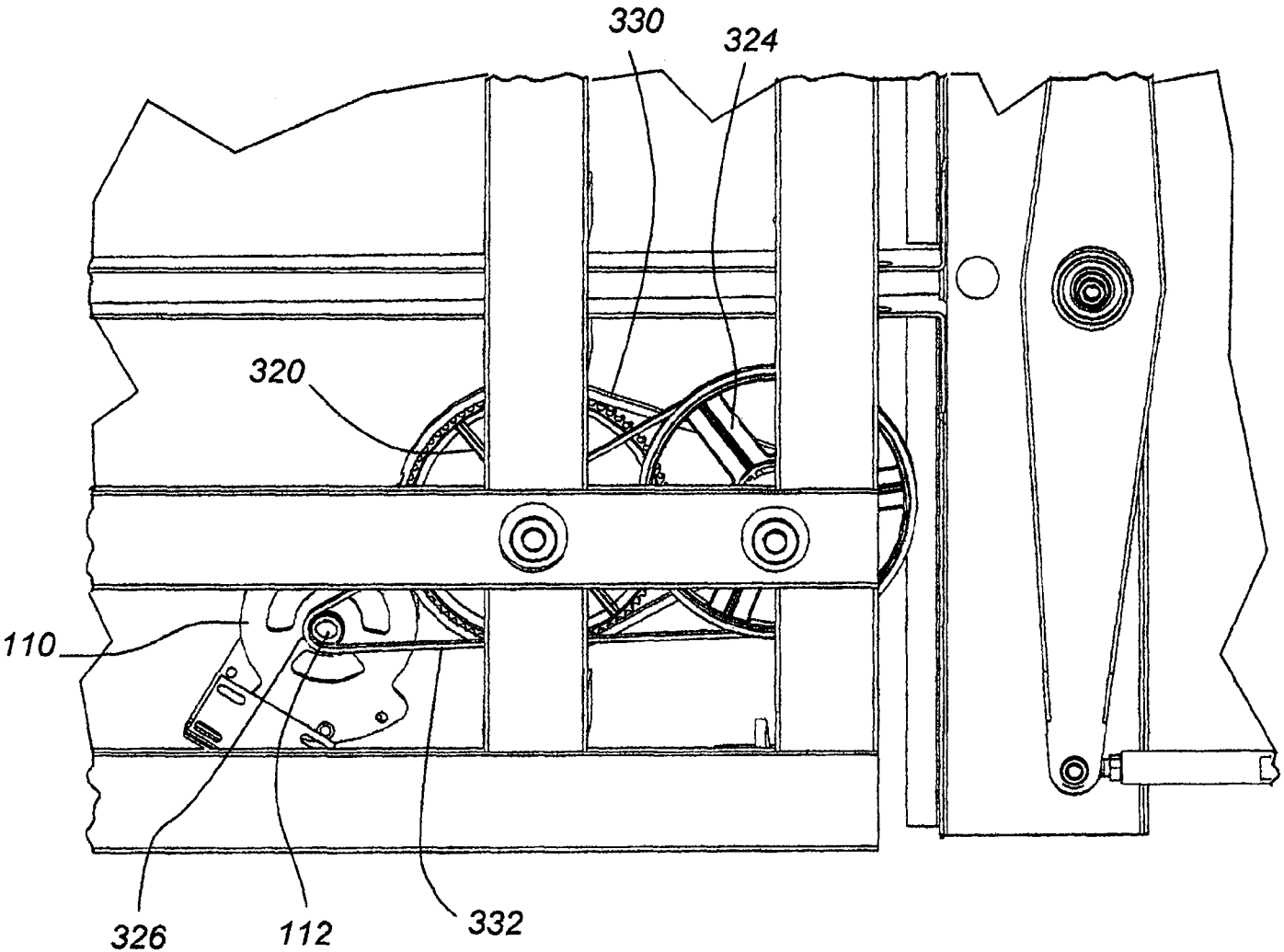
FIG. 18 is a bottom view of the transmission assembly shown in FIG. 15.
Figure 19:
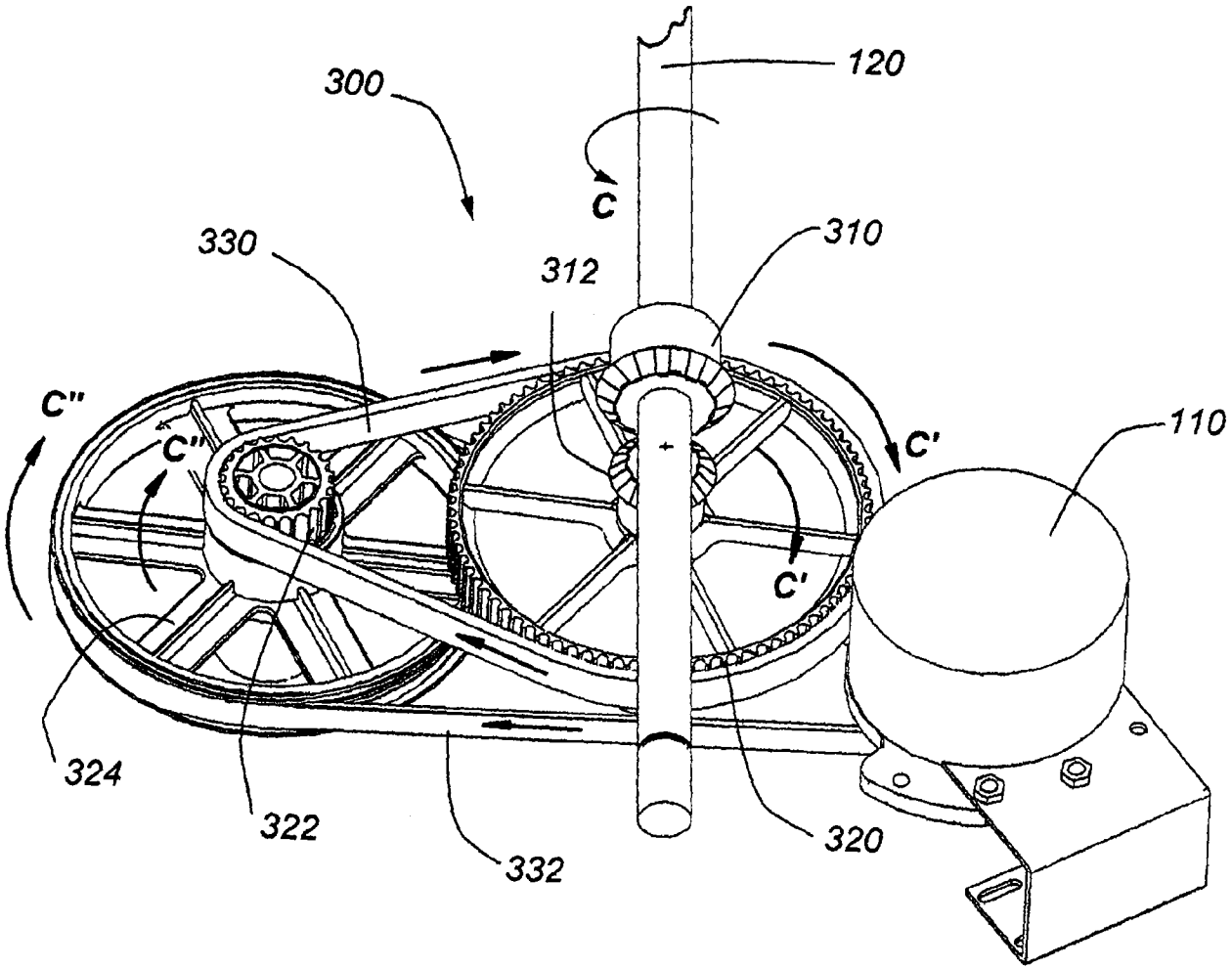
FIG. 19 is a diagrammatic view of directional movements of various components of the transmission assembly of FIG. 15.
Figure 20:
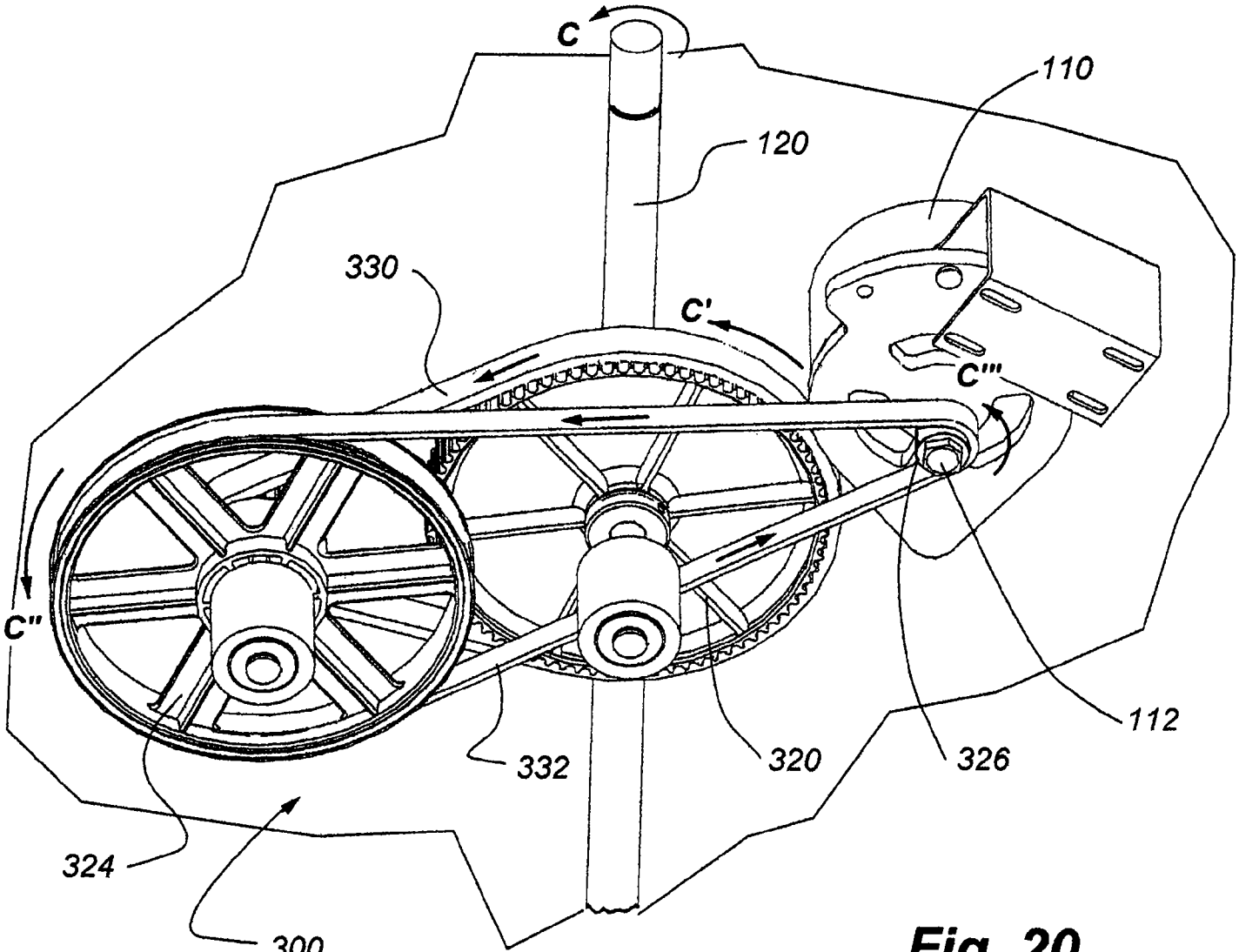
FIG. 20 is another diagrammatic view of directional movements of various components of the transmission assembly of FIG. 15.

FIGS. 15 and 16 are diagrammatic views of a transmission assembly 300 operably connecting the drive shaft 120 with an alternator (alternator resistance source) of the present invention. FIG. 17 is a top view of the transmission assembly 300 shown in FIGS. 15 and 16. FIG. 18 is a bottom view of the transmission assembly 300 shown in FIGS. 15 and 16. FIGS. 19 and 20 are diagrammatic views of directional movements of various components of the transmission assembly 300 in FIGS. 15 and 16.

As shown in FIGS. 15-20, the transmission assembly 300 includes a first gear member 310 connected with the drive shaft 120, and as such, rotates around a substantially horizontally-oriented axis of rotation. The first gear member 310 is engaged with a second gear member 312 rotatably supported by the frame 11. The second gear member 312 is arranged have a substantially vertically oriented axis of rotation. The first gear member 310 has a beveled gear face adapted to engage a beveled gear face on the second gear member 312. The interaction of the beveled gear faces translates the substantially horizontally oriented axis of rotation of first gear member 310 to the substantially vertically oriented axis of rotation of the second gear member 312. As such, rotation of the drive shaft 120 and first gear member 310 causes the second gear member 312 to rotate. As shown in FIG. 15-20, the second gear member 312 is connected with a first pulley 320 located below the second gear member 312. As such, the second gear member 312 and the first pulley 320 rotate together. A first belt 330 connects the first pulley 320 with a second pulley 322 rotatably supported by the frame 11 and having a substantially vertically oriented axis of rotation. The second pulley 322, in turn, is connected with a third pulley 324 located below the second pulley 322. As such, the second pulley 322 and the third pulley 324 rotate together. A second belt 332 connects the third pulley 324 with a fourth pulley 326 connected with an alternator shaft 112 extending from the alternator resistance source 110. The alternator resistance source 110, in turn, is connected with frame 11.

In operation, the downward pivotal movement of either treadle 20, 30 causes the drive shaft 120 to rotate in the drive direction, shown as direction C in FIGS. 19-20, which in turn, causes the first gear member 310 to rotate in direction C. Rotation of the first gear member 310 in direction C causes the second gear member 312 and the first pulley 320 to rotate in direction C' shown in FIGS. 19-20. Because first belt 330 connects the first pulley 320 with the second pulley 322, rotation of the first pulley 320 in direction C' causes the second pulley 322 and third pulley 324 to rotate in direction C". Because second belt 332 connects the third pulley 324 with the fourth pulley 326, rotation of the first pulley 320 in direction C" causes the fourth pulley 326 and alternator shaft 112 to rotate in direction C'". The alternator resistance source 110 can be controlled and monitored to resist rotation of the alternator shaft 112.

As shown in FIGS. 15-20 and others, the pulleys in the transmission assembly 300 can be configured with teeth adapted to mesh with corresponding ribs on the belts. Other embodiments utilize smooth belts and pulleys. In addition, the components of the transmission assembly 300 can be configured with different gear ratios such that the rotation of the drive shaft 120 can have different rotational effects on the rotation of the alternator shaft 112. For example, in one embodiment, the transmission assembly 300 is configured with an overall gear ratio between the drive shaft 120 and the alternator resistance source 110 of 11.5-to-1. Such a gear ratio can be achieved differently sized gears and pulleys. For example, in one embodiment, the gear ratio between the first gear member 310 and the second gear member 312 is 1-to-1, while the first pulley 320 and second pulley 322 are sized to provide a 3.5-to-1 gear ratio between the first pulley 320 and second pulley 322. In the same embodiment, the third pulley 324 and fourth pulley 326 are sized to provide a 8-to-1 gear ratio between the third pulley 324 and the fourth pulley 326. Other embodiments of the transmission assembly 300 are configured differently so that the ratio can be greater than or less than 11.5-to-1.

Although the treadles 20, 30 described above are configured to interface with the drive shaft 120 through treadle sprockets 134, 136, chains 154, 156, and drive sprockets 124, 126, it is to be appreciated that other embodiments can be configured such that the treadles 20, 30 interface with the resistance system 100 through various different arrangements and combinations of pulleys, belts, and/or gears.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

a first treadle assembly pivotally connected with the frame to pivot about a lateral pivot axis and including a first endless belt providing a first moving surface, the first endless belt being longitudinally movably supported about at least two rollers and driven by at least one of the at least two rollers, the at least one of the at least two rollers including a lateral axis of rotation;

a second treadle assembly pivotally connected with the frame to pivot about the lateral pivot axis and including a second endless belt providing a second moving surface;

a drive shaft rotatably supported by the frame;

at least one driving member operably connecting at least one of the first and second treadle assemblies with the drive shaft; and a resistance source operably connected with the drive shaft and configured to resist rotation of the drive shaft;

wherein the first treadle assembly and the second treadle assembly are operably connected with the drive shaft such that pivotal movement of the first treadle assembly about the lateral pivot axis and pivotal movement of the second treadle assembly about the lateral pivot axis cause the drive shaft to rotate, and wherein the at least one driving member comprises:

an elongate member including a first end and a second end, the elongate member connected with the frame at the first end and configured to translate longitudinally relative to the frame; and a treadle member connected with at least one of the first and second treadle assemblies to move therewith and to extend downward from the at least one of the first and second treadle assemblies, and configured to engage the elongate member such that the elongate member translates longitudinally and causes the drive shaft to rotate as the first and second treadle assemblies pivot about the lateral pivot axis.

2. The exercise device of claim 1 wherein the pivotal movements of the first and second treadle assemblies are interconnected by an interconnection assembly operably coupled between the first treadle assembly and the second treadle assembly.

3. The exercise device of claim 1, wherein the resistance source comprises an alternator.

4. The exercise device of claim 1, further comprising:

a chain connected with the frame;

a first sprocket connected with drive shaft and engaged with the chain;

a second sprocket connected with the treadle member of the first treadle and configured to engage the chain to rotate the first sprocket as the first treadle pivots about the lateral pivot axis.

5. The exercise device of claim 4, further comprising a one-way bearing operably connecting the first sprocket with the drive shaft.

6. The exercise device of claim 4, further comprising a spring disposed between and connected with the chain at the second end and the frame.

7. The exercise device of claim 6, wherein a first end of the chain is fixed relative to the frame.

8. The exercise device of claim 4, wherein the second sprocket is configured to free wheel in both directions of rotation.

9. The exercise device of claim 4, wherein the second sprocket is carried by the first treadle assembly.

10. The exercise device of claim 1, further comprising:

a belt connected with the frame;

a first pulley connected with drive shaft and engaged with the belt;

a second pulley connected with the treadle member of the first treadle and configured to engage the belt to rotate the first pulley as the first treadle pivots about the lateral pivot axis.

11. The exercise device of claim 10, further comprising a one-way bearing operably connecting the first pulley with the drive shaft.

12. The exercise device of claim 10, further comprising a spring disposed between and connected with the belt at the second end and the frame.

13. The exercise device of claim 12, wherein a first end of the belt is fixed relative to the frame.

14. The exercise device of claim 10, wherein the second pulley is configured to free wheel in both directions of rotation.

15. The exercise device of claim 10, wherein the second pulley is carried by the first treadle assembly.

16. The exercise device of claim 1, wherein the drive shaft is disposed beneath both the first and second treadle assemblies.

17. The exercise device of claim 1, wherein the drive shaft includes a drive axis of rotation that is disposed parallel to the lateral axis of rotation of the at least one of the at least two rollers of the first treadle assembly.

18. The exercise device of claim 1, wherein the drive shaft includes a drive axis of rotation that is disposed parallel to the lateral pivot axis of the first and second treadle assemblies.

19. The exercise device of claim 3, wherein the alternator is disposed beneath at least one of the first and second treadle assemblies.

20. The exercise device of claim 1, wherein at least the elongate member of the at least one driving member is disposed beneath at least one of the first and second treadle assemblies.

21. The exercise device of claim 1, wherein the drive shaft is disposed beneath at least one of the first and second treadle assemblies.

22. The exercise device of claim 1, wherein the at least one driving member comprises:

a first elongate member including a first end and a second end, the first elongate member connected with the frame at the first end, engaging the first treadle assembly at the second end, and configured to translate longitudinally relative to the frame;

a second elongate member including a first end and a second end, the second elongate member connected with the frame at the first end, engaging the second treadle assembly at the second end, and configured to translate longitudinally relative to the frame;

a first treadle member connected with the first treadle assembly to move therewith and to extend downward from the first treadle assembly, and configured to engage the first elongate member such that the first elongate member translates longitudinally and causes the drive shaft to rotate as the first treadle assembly pivots about the lateral pivot axis; and a second treadle member connected with the second treadle assembly to move therewith and to extend downward from the second treadle assembly, and configured to engage the second elongate member such that the second elongate member translates longitudinally and causes the drive shaft to rotate as the second treadle assembly pivots about the lateral pivot axis.

23. The exercise device of claim 1, wherein the at least one driving member comprises:

first and second chains each configured to be connected with the frame of the exercise device;

first and second sprockets connected with drive shaft and configured to be engaged with the first and second chains respectively;

third and fourth sprockets configured to be connected with the first and second treadle assemblies respectively of the exercise device and to engage the first and second chains respectively to rotate the first and second sprockets respectively as the first and second treadle assemblies move.

24. The exercise device of claim 23, further comprising first and second one-way bearings respectively operably connecting the first and second sprockets with the drive shaft.

25. The exercise device of claim 23, further comprising first and second springs respectively connected with the first and second chains at a first end thereof, a second end of the first and second chains configured to be fixed relative to a frame of the exercise device.

26. The exercise device of claim 1, wherein the at least one driving member comprises:

first and second belts configured to be connected with a frame of the exercise device;

first and second pulleys connected with drive shaft and configured to be engaged with the first and second belt respectively;

third and fourth pulleys respectively connected with the first treadle assembly and the second treadle assembly and respectively adapted to engage the first and second belts to rotate the first and second pulleys respectively as the first and second treadle assemblies move.

27. The exercise device of claim 26, further comprising first and second one-way bearings respectively operably connecting the first and second pulleys with the drive shaft.

28. The exercise device of claim 26, further comprising first and second springs respectively connected with the first and second belts at a first end thereof, a second end of the first and second belts configured to be fixed relative to a frame of the exercise device.

* * * * *